US006352253B1

(12) United States Patent
Hayakawa et al.

(10) Patent No.: US 6,352,253 B1
(45) Date of Patent: Mar. 5, 2002

(54) DISCHARGED SHEET STACKING APPARATUS AND IMAGE FORMING APPARATUS HAVING SUCH STACKING APPARATUS

(75) Inventors: Yasuyoshi Hayakawa; Teruo Komatsu; Tsuyoshi Waragai, all of Mishima; Atsushi Ogata, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/251,492

(22) Filed: Feb. 17, 1999

(30) Foreign Application Priority Data

Feb. 20, 1998 (JP) ..... 10-039446
Feb. 20, 1998 (JP) ..... 10-039447
Feb. 20, 1998 (JP) ..... 10-039448

(51) Int. Cl.[7] ..... B65H 39/10

(52) U.S. Cl. ..... 270/58.12; 270/58.27; 270/59; 271/188; 271/198; 271/314

(58) Field of Search ..... 270/59, 58.07, 270/58.08, 58.12, 58.27; 271/209, 188, 198, 314, 207; 399/407, 408, 410, 405

(56) References Cited

U.S. PATENT DOCUMENTS 4,056,264 A * 11/1977 Dboose et al. ..... 271/314
4,657,241 A * 4/1987 Frank ..... 271/209
5,005,821 A * 4/1991 Burger ..... 271/198
5,147,092 A * 9/1992 Driscoll et al. ..... 271/198
5,253,861 A * 10/1993 Schmaling ..... 271/209
5,288,062 A * 2/1994 Rizzolo et al. ..... 270/58.12
5,473,420 A * 12/1995 Rizzollo et al. ..... 270/58.08

FOREIGN PATENT DOCUMENTS

JP 403259857 A * 11/1991 ..... 271/314

* cited by examiner

*Primary Examiner*—H. Grant Skaggs
(74) *Attorney, Agent, or Firm*—Fitzpatrick, Cella, Harper & Scinto

(57) ABSTRACT

A discharged sheet stacking apparatus includes a sheet feed-in device for pinching and feeding a sheet onto a sheet stacking portion on which a plurality of sheets are stacked and for causing a tip end of the sheet to abut against a sheet stopper. The sheet feed in device is disposed at a position spaced apart from the sheet stopper by a distance smaller than a length of the sheet. The sheet feed-in device continues the feeding operation while pinching a tail end of the sheet even after the tip end of the sheet abuts against the sheet stopper so that, after a loop is formed in the tail end of the sheet, the sheet is discharged onto the sheet stacking portion.

8 Claims, 21 Drawing Sheets

DISCHARGED SHEET STACKING APPARATUS AND IMAGE FORMING APPARATUS HAVING SUCH STACKING APPARATUS

BACKGROUND OF THE INVENTION

1. Field of the Invention

The present invention relates to a discharged sheet stacking apparatus in which imaged sheets are book-bound by a book-binding means such as a stapler and are discharged and stacked, and an image forming apparatus having such a stacking apparatus.

More particularly, the present invention relates to a discharged sheet stacking apparatus in which, sheets are temporarily stopped for both-face imaging treatment and stapling treatment, the sheets are discharged, and an image forming apparatus such as a printer, a copying machine and the like, having such a stacking apparatus.

2. Related Background Art

As discharged sheet stacking apparatus for a laser beam printer (image forming apparatus) having a book-binding apparatus such as a stapler, a stacking apparatus which is connected to a side of the printer body including a discharge opening and in which imaged sheets are stapled for each job and are discharged and stacked is well known. However, since such a discharged sheet stacking apparatus has a discharged sheet switch-back mechanism for permitting the imaged sheets to be stapled and stacked in a page sequence, an installation area is increased and, since a sheet-to-sheet distance is increased to ensure the switch-back of the sheet, through-put of print is worsened.

To avoid such inconveniences, there has been proposed a discharged sheet stacking apparatus in which sheets are conveyed in a reverse manner and are stacked on an upper surface of a printer to omit a reversing mechanism. However, in order to stack a large number of sheets in such a discharged sheet stacking apparatus, strength of the printer body for supporting the sheets must be increased, thereby increasing the cost of the printer body.

To avoid such inconvenience, there has been proposed a discharged sheet stacking apparatus of so-called "lower-installed" type in which a discharged sheet stacking portion is disposed below a printer body, and a flapper (branching means) for feeding sheets to a sheet discharge apparatus arranged below the printer body is provided in a sheet discharge path of the printer body and a convey portion for conveying the sheet downwardly from the flapper to the sheet discharge apparatus is provided out of the printer body, and an actuator for actuating the flapper of the printer body is provided in the convey portion, thereby avoiding such inconvenience.

However, in order to effect the book-binding by using the book-binding means such as the stapler, a plurality of sheets must be aligned with each other for each job. Generally, in a conventional aligning means, a sheet aligning portion is inclined with respect to a horizontal plane by about 10° to 30° so that the sheets are aligned with each other by abutting the sheets against a vertical wall portion provided at an inclined end by utilizing the inclination of the sheet aligning portion.

When the aligning means having the inclined surface is used at the sheet stacking portion in this way, a height of the discharged sheet stacking apparatus becomes great, so that, when the discharged sheet stacking apparatus is installed below the printer as mentioned above, the entire height of the printer is increased. As a result, it will be difficult for the user to handle the uppermost printer.

Further, a sheet bundle stapling mechanism used with the conventional discharged sheet stacking apparatus is designed so that a stapling mechanism portion is shifted along a sheet bundle comprised of sheets aligned with each other on a sheet stacking tray (sheet stacking portion) to staple any position(s) of the sheet bundle. That is to say, in the sheet bundle stapling mechanism provided in the image forming apparatus, after a predetermined number of sheets on which toner images were recorded in an image forming portion are conveyed onto the sheet stacking tray and are aligned there, the stapling mechanism portion is shifted to the predetermined position at the end portion of the aligned sheet bundle on the sheet stacking tray to effect the stapling operation.

However, in the above-mentioned conventional sheet bundle stapling mechanism, the stapling mechanism portion must be shifted by distances corresponding to various sizes of various sheets in order to staple any position on the end portion of the sheet bundle.

Thus, the sheet bundle stapling mechanism becomes complicated, and, since the stapling mechanism portion is shifted, the possibility of occurrence of malfunction will be increased. Further, since a space through which the stapling mechanism portion is shifted must be reserved, it is difficult to make the apparatus compact.

Accordingly, it is difficult to manufacture the conventional sheet bundle stapling mechanism with cheap cost, and a greater installation area for the image forming apparatus having the discharged sheet stacking apparatus is required.

Further, in some sheet bundle stapling mechanisms of the conventional discharged sheet stacking apparatus, the stapling treatment is effected by temporarily stopping or waiting the sheet in the sheet convey path.

The sheet conveyed through a vertical convey portion is received in the discharged sheet stacking apparatus by a pair of align and convey-in rollers and is guided onto an align table (sheet stacking portion). The sheets abut against a tip end stopper portion of a sheet stopper to be stacked on the align table.

When a predetermined number of sheets are stacked on the align table as a sheet bundle, the sheets are aligned with each other in a feeding direction and in a direction perpendicular to the feeding direction and then are pinched by a pair of bundle convey rollers (sheet convey rollers). When the convey path is released by rotating the tip end stopper portion in a retard direction, the sheets are conveyed and discharged from the discharged sheet stacking apparatus in the form of the sheet bundle.

In the above-mentioned discharged sheet stacking apparatus, in order to make the apparatus itself simpler and to achieve reduction of cost, a lower bundle convey roller among the pair of bundle convey rollers does not include a drive connection/disconnection means such as a clutch.

Thus, the lower bundle convey roller continues to rotate while supporting (from the below) the sheets urged against the tip end stopper portion. Further, the lower bundle convey roller is positioned substantially flush with an upper surface of the align table to bundle-convey the sheets.

In this way, since the lower bundle convey roller continues to rotate at the position substantially flush with the upper surface of the align table, the roller continues to rub a lowermost sheet in the sheet bundle urged against the tip end stopper portion.

Therefore, the conventional discharged sheet stacking apparatuses have the disadvantages that the surface of the sheet is damaged and the image formed on each sheet is distorted to damage the image.

SUMMARY OF THE INVENTION

An object of the present invention is to provide a discharged sheet stacking apparatus and an image forming apparatus, in which the above-mentioned conventional drawbacks can be eliminated and which have a small height.

To achieve the above object, according to the present invention, there is provided a discharged sheet stacking apparatus characterized in that a sheet feed-in means for pinching and feeding-in a sheet onto a sheet stacking portion on which a plurality of sheets are stacked and for causing a tip end of the sheet to abut against a sheet stopper retractable with respect to the sheet stacking portion is disposed at a position spaced apart from the sheet stopper by a distance smaller than a length of the sheet, and the sheet feed-in means continues the feed-in operation while pinching a tail end of the sheet even after the tip end of the sheet abuts against the sheet stopper so that after a loop is formed in the tail end the sheet is stacked onto the sheet stacking portion.

The discharged sheet stacking apparatus may include a sheet auxiliary convey means for conveying the sheet on the sheet feed-in means auxiliary provided between the sheet feed-in means and the sheet stopper.

The sheet auxiliary convey means may comprise an endless belt rotated in a sheet conveying direction.

The discharged sheet stacking apparatus may include biasing means for biasing the tail end of the sheet fed-in by the sheet feed-in means toward the conveying direction.

The biasing means may comprise an endless belt rotated in synchronous with the sheet feed-in means.

The endless belt may be designed so that it drops the sheet while receiving the tail end of the sheet in a condition that the tip end of the sheet abuts against the sheet stopper.

The discharged sheet stacking apparatus may include a staple unit for stapling the sheets stacked on the sheet stacking portion.

Further, the present invention provides an image forming apparatus in which the above-mentioned discharged sheet stacking apparatus is positioned at a lower portion of a main body including an image forming portion for forming an image.

Another object of the present invention is to provide a discharged sheet stacking apparatus which can eliminate the above-mentioned conventional drawbacks and in which a stapling mechanism portion is simplified to minimize malfunction of the stapling mechanism portion.

To achieve this object, according to the present invention, there is provided a discharged sheet stacking apparatus comprising a sheet stacking portion on which fed-in sheets are stacked, and a stapling mechanism portion for aligning ends of the sheets fed-in to the sheet stacking portion to form a sheet bundle and for stapling the sheet bundle, and wherein it further comprises a sheet stopper adapted to align the ends of the sheets conveyed to the sheet stacking portion and retractable with respect to the sheet stacking portion, an aligning member for aligning the sheet in a sheet width-wise direction, a convey means for pinching the sheet bundle from above and below and for conveying the sheet bundle in which the sheets are aligned in the sheet width-wise direction and the ends of the sheets are aligned by the sheet stopper, and a control means for shifting the sheet bundle to a stapling position where the sheet bundle is stapled by the stapling mechanism portion, after the sheet stopper is retracted in response to a stapling mode.

The discharged sheet stacking apparatus may include a drive means for shifting the aligning member, a detecting means for detecting the fact that the sheet is conveyed to the sheet stacking portion, and the control means may control the drive means in such a manner that the aligning member is shifted to an align position whenever the detecting means detects the fact that the sheet is conveyed to the sheet stacking portion, and, when the sheet bundle is conveyed after all of the sheets are stacked on the sheet stacking portion, the aligning member is shifted to a convey position.

Further, according to the present invention, the aligning member may include an elastic member for urging the sheets elastically.

A further object of the present invention is to provide a discharged sheet stacking apparatus and an image forming apparatus having such a discharged sheet stacking apparatus, which can eliminate the above-mentioned conventional drawbacks and in which a surface of a sheet is not damaged and an image formed on the sheet is not damaged.

To achieve this object, according to the present invention, there is provided a discharged sheet stacking apparatus comprising a sheet stacking portion on which a plurality of sheets can be stacked, a storing means for storing the sheets on the sheet stacking portion, and a pair of sheet convey rollers for pinching and discharging the sheets on the sheet stacking portion, and wherein one of the pair of sheet convey rollers is positioned near the sheet stacking portion and the other rollers can be engaged by and disengaged from the one roller from the above, and further wherein it further comprises a sheet receiving member disposed above the one roller and adapted to support the sheets on the sheet stacking portion and to be retarded to contact the sheet with the one roller when the storing means releases the storing of the sheets and the other roller is lowered.

The storing means may comprise a sheet stopper retractable with respect to the sheet stacking portion and adapted to receive the sheets, and the sheet receiving member may comprise a rotatable link piece operated in synchronous with the sheet stopper. The link piece is protruded above the one roller when the sheet stopper is protruded above the sheet stacking portion and is retarded when the sheet stopper is retracted into the sheet stacking portion.

The sheet receiving member may comprise a link piece rotatingly biased by an elastic body toward a direction for protruding the link piece above the one roller, which link piece is retarded by being urged by the other roller being lowered.

The sheet receiving member may comprise a rotary cover rotatably provided coaxial with the one roller and rotatingly biased by an elastic body toward a direction for protruding the rotary cover above the one roller, which rotary cover is rotatingly retarded by being contacted with the other roller being lowered.

The above-mentioned conventional drawbacks can be eliminated by an image forming apparatus according to the present invention comprising an image forming portion for forming an image and the above-mentioned discharged sheet stacking apparatus.

DESCRIPTION OF THE PREFERRED EMBODIMENTS

[First Embodiment]

Figure 3:
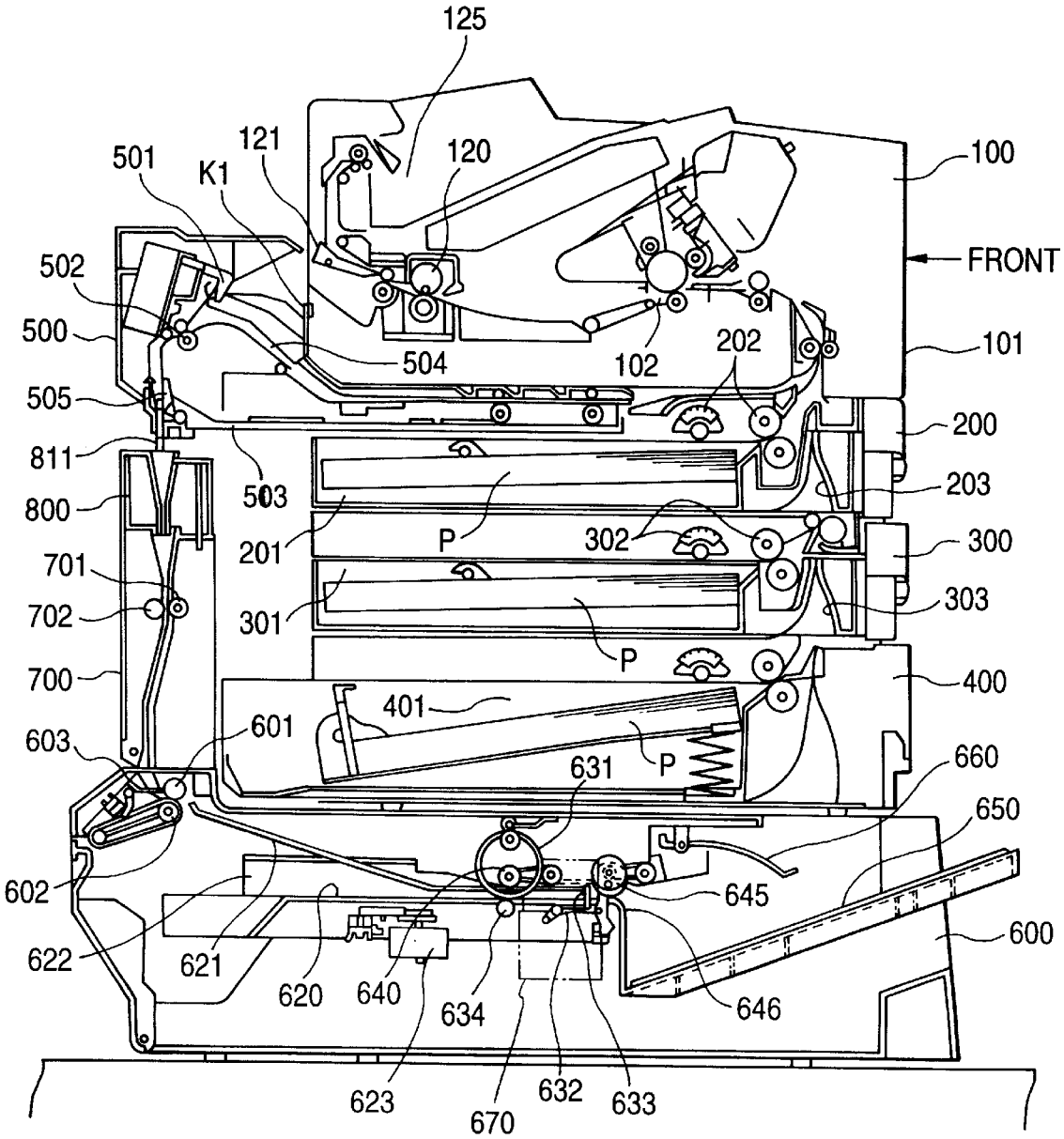
FIG. 3 is a front sectional view of a printer having the discharged sheet stacking apparatus according to the first embodiment.

FIG. 3 is a front sectional view of a laser beam printer (image forming apparatus) to which a discharged sheet stacking apparatus 600 according to a first embodiment of the present invention is mounted.

First of all, a printer representative of the laser beam printer will be explained.

The printer 100 is solely connected to a computer or a network such as an LAN so that, on the basis of information sent from such computer and the like, an image is formed on a sheet by a predetermined image forming process in an image forming portion 102 and then the imaged sheet is discharged.

A first sheet supplying device 200 comprises a detachable sheet cassette 201 for containing a plurality of sheets P, and a sheet separation and supply portion 202 for separating the sheets P contained in the sheet cassette in response to a predetermined sheet supply signal and for conveying the separated sheet to a main body 101 of the printer. The sheet supplying device 200 further comprises a sheet guide portion 203 for conveying a sheet P from a second or third sheet supply device 300 or 400 which can be used positioned below the first sheet supply device.

Similar to the first sheet supply device 200, the second sheet supply device 300 comprises a sheet cassette 301 for containing sheets P, a sheet separation and supply portion 302, and a sheet guide portion 303 for conveying the sheet from the third sheet supply device.

The third sheet supply device 400 has the same construction as the first or second sheet supply device 200 or 300, and a sheet cassette 401 of the third sheet supply device 400 is designed to contain a larger number of sheets P than the sheet cassettes 201, 301 of the first and second sheet supply devices 200, 300. Further, the sheet cassette 401 has a greater length so that longer sheets can be contained in the sheet cassette, and a rear end of the sheet cassette 401 is protruded from the printer body 101.

The sheet supply devices 200, 300, 400 are positioned with respect to each other by identical positioning pins and fitting holes, so that, when the sheet supply devices are installed in a laminated condition, they are electrically interconnected by connectors and are automatically connected to the printer 100 and other sheet cassettes 201, 301, 401. Thus, the printer 100 can ascertain its connection condition.

Accordingly, the user can select the number of cassettes and capacity of cassette to meet the specification among a plurality of variations.

A both-face unit 500 can be mounted to the printer 100 along a guide configuration formed in the printer 100 from the left in FIG. 3.

The printer 100 and the both-face unit 500 are electrically interconnected through their connectors so that supply of electricity and communication from the printer 100 to the both-face unit 500 can be permitted and the printer 100 can ascertain its connection condition.

A discharged sheet stacking apparats 600 forms a part of the printer 100 and is designed so that the sheets sent from the printer are bundled in a face-down manner for each job through a vertical convey portion 700 and an extension guide 800 and are stapled at one or more locations and then are discharged or the sheets are merely discharged and stacked in a face-down manner.

Next, the discharged sheet stacking apparatus 600 according to the first embodiment will be explained along a convey path for the sheet P.

In response to a predetermined print signal, an image is transferred (in a face-up fashion) onto the sheet P selectively supplied from the desired sheet cassette 201, 301 or 401 by the image forming process in the printer 100, and, thereafter, the transferred image is fixed to the sheet P by a fixing means 120.

The sheet to which the image was fixed is selectively branched and conveyed to an FD sheet discharge portion 125 provided on an upper surface of the printer body 101 or to the both-face unit 500, by an FD flapper 121 in response to a predetermined signal.

The sheet P conveyed into the both-face unit 500 actuates a both-face convey sensor lever 501.

In a both-face print mode, the both-face convey sensor lever 501 actuated by the conveyed sheet P drives a downstream both-face convey roller 502 at a predetermined timing to direct the sheet to a reverse convey path 503. Then, after the fact that a tail end of the sheet P leaves the both-face convey sensor lever 501 is detected, the both-face convey roller 502 is reversely driven at a predetermined timing. As a result, the sheet P is conveyed to a both-face convey path 504 to be returned to the printer 100 again, thereby permitting both-face imaging treatment.

Figure 10:
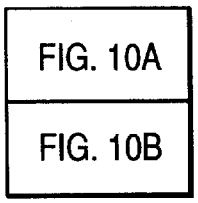
FIG. 10, which is composed of FIGS. 10A and 10B, are flowcharts for explaining a stapling operation for sheets.
Figure 10A:
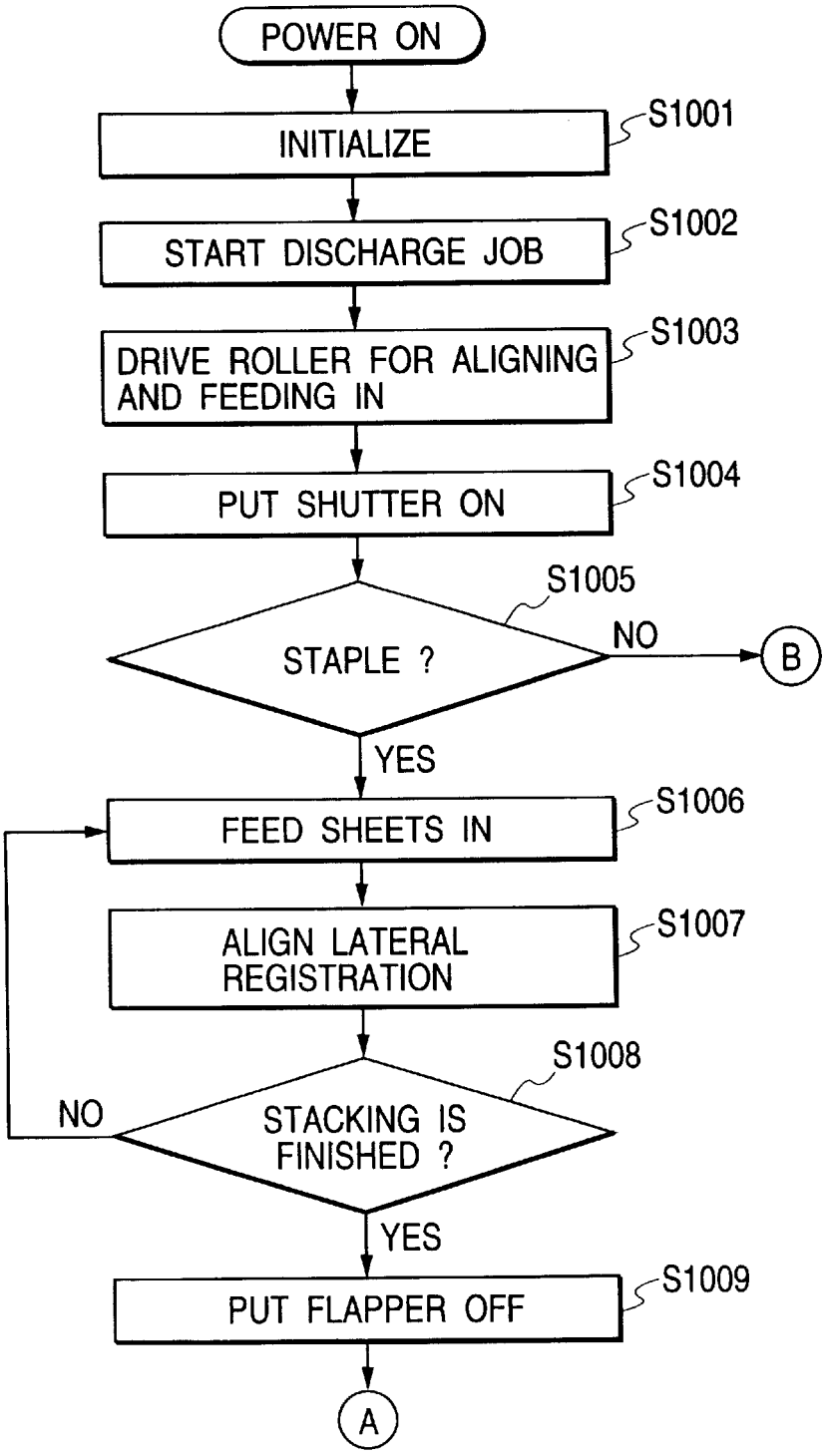
Figure 10B:
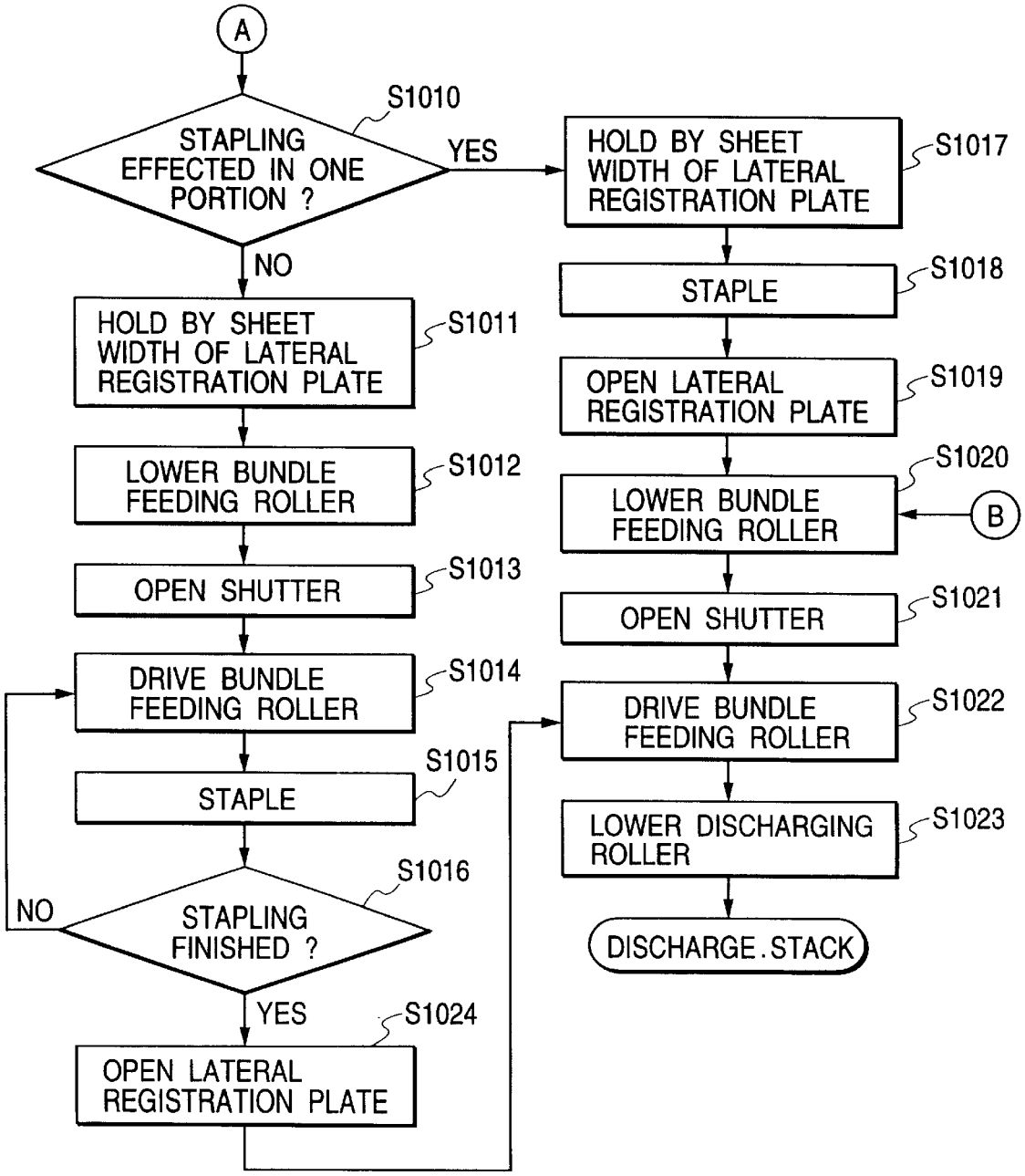
Figure 11:
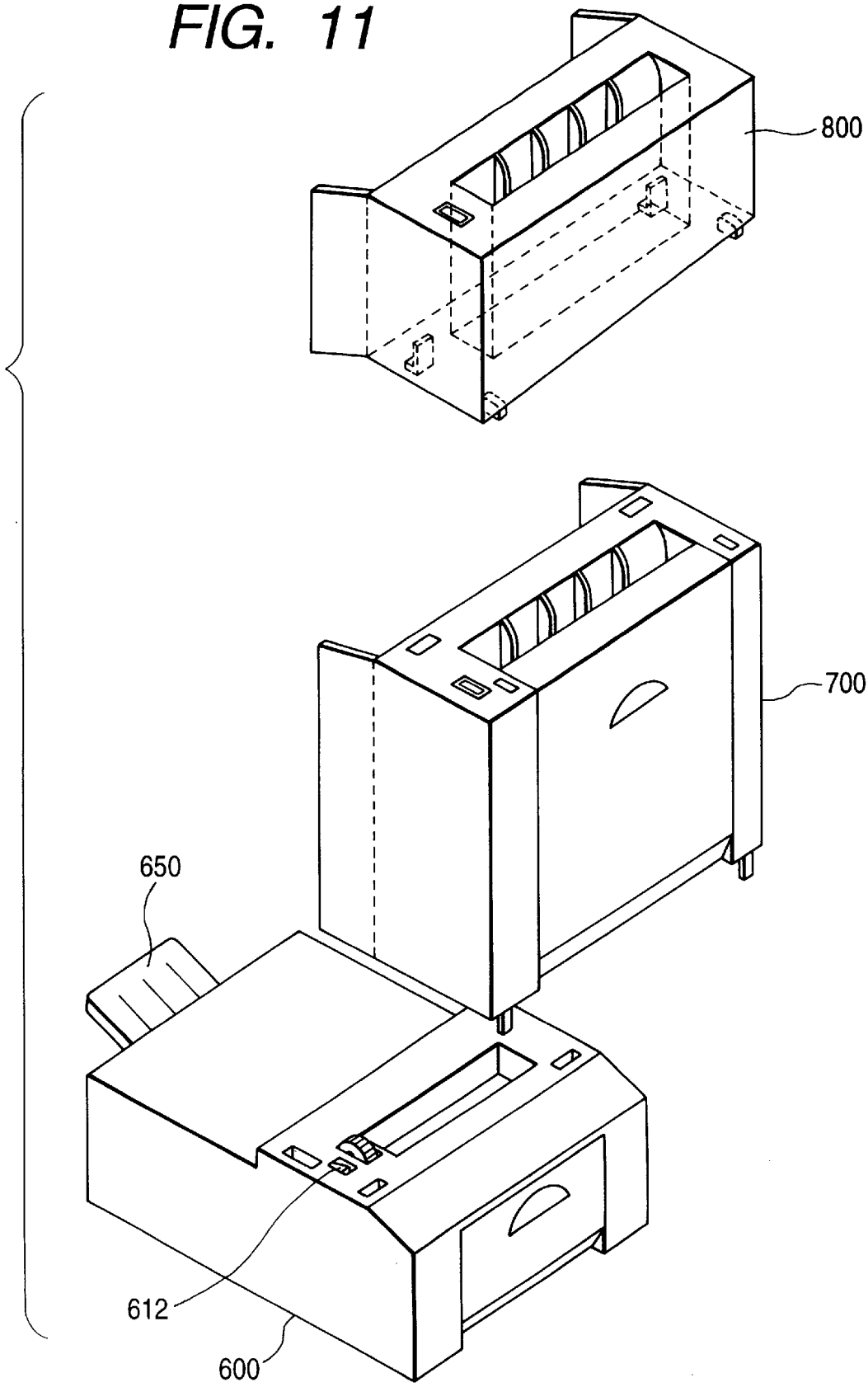
FIG. 11 is a perspective view showing the discharged sheet stacking apparatus according to the first embodiment, a vertical convey portion and an extension guide.
Figure 12:
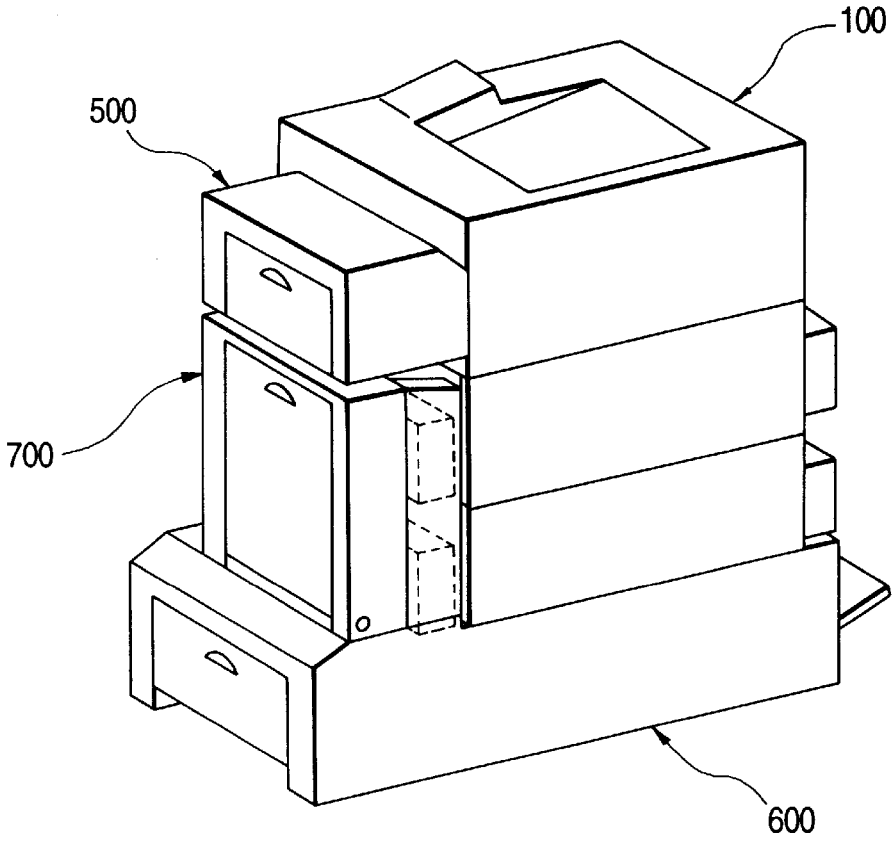
FIG. 12 is a perspective view of a printer having the discharged sheet stacking apparatus according to the first embodiment.

Next, movements of various element when the conveyed sheet P is directed toward the discharged sheet stacking apparatus 600 will be explained with reference to a flowchart shown in FIG. 10.

The discharged sheet stacking apparatus 600 is initialized (step S1001).

When the sheet P conveyed to the both-face unit 500 (step S1002) actuates the both-face convey sensor lever 501, the sensor drives the downstream convey roller 502 at the predetermined timing and outputs a signal to the discharged sheet stacking apparatus 600, thereby driving a plunger 611 of a flapper solenoid 610 (FIG. 20) provided within the discharged sheet stacking apparatus 600. A lever 612 shown in FIG. 20 is pivotally connected to the plunger 611.

Figure 20:
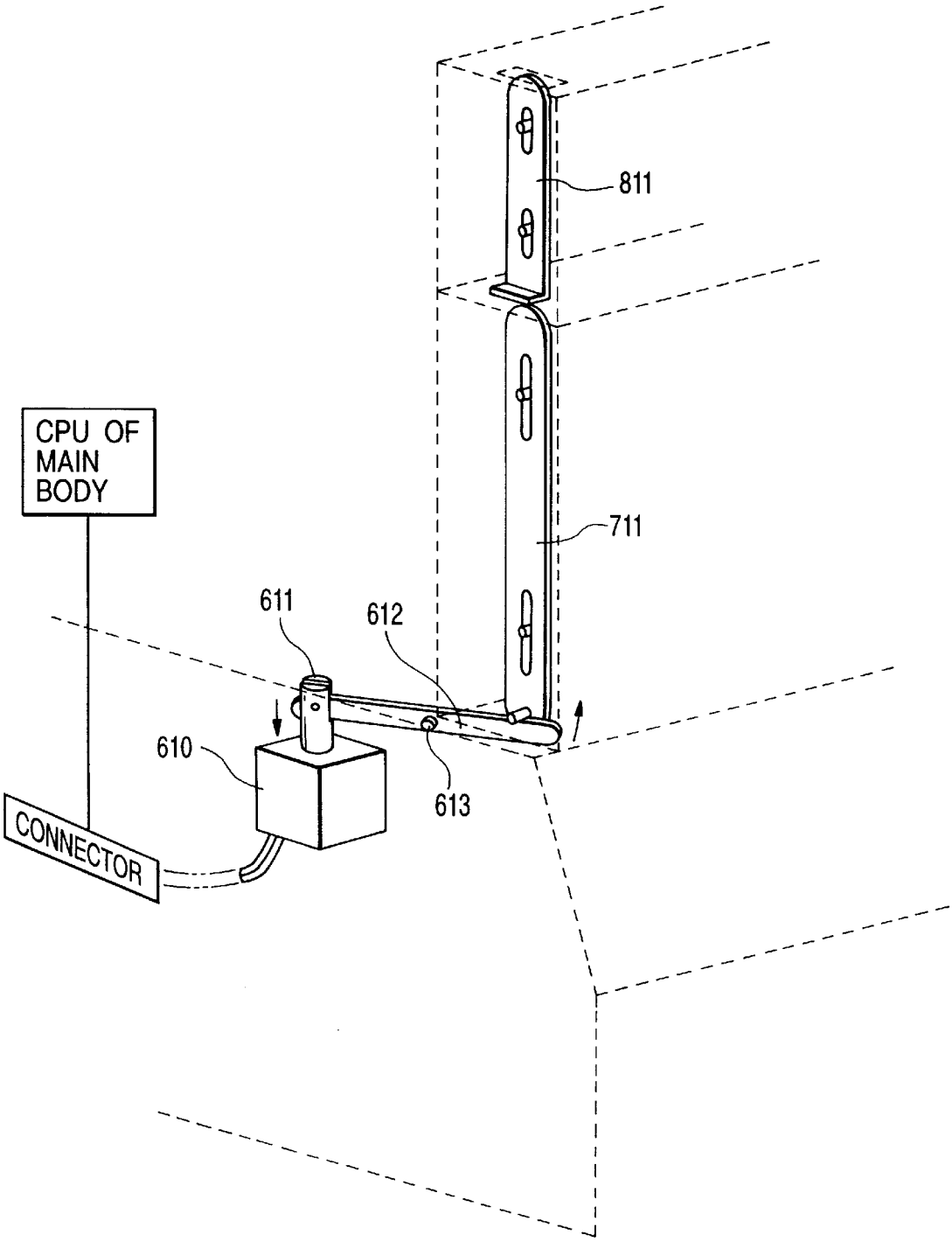
FIG. 20 is a schematic perspective view showing a linkage for operating a both-face unit and a vertical convey portion in synchronous with each other.

Since the lever 612 is supported by a rotary shaft 613 shown in FIG. 20, the lever is rotated around the rotary shaft to lift a link lever 711 which in turn pushes a link lever 811 upwardly, thereby rotating a flapper of the both-face unit 500. The convey path is switched by the flapper 505, with the result that the sheet P is conveyed in the discharged sheet stacking apparatus through the extension guide 800 and the vertical convey portion 700.

Figure 4:
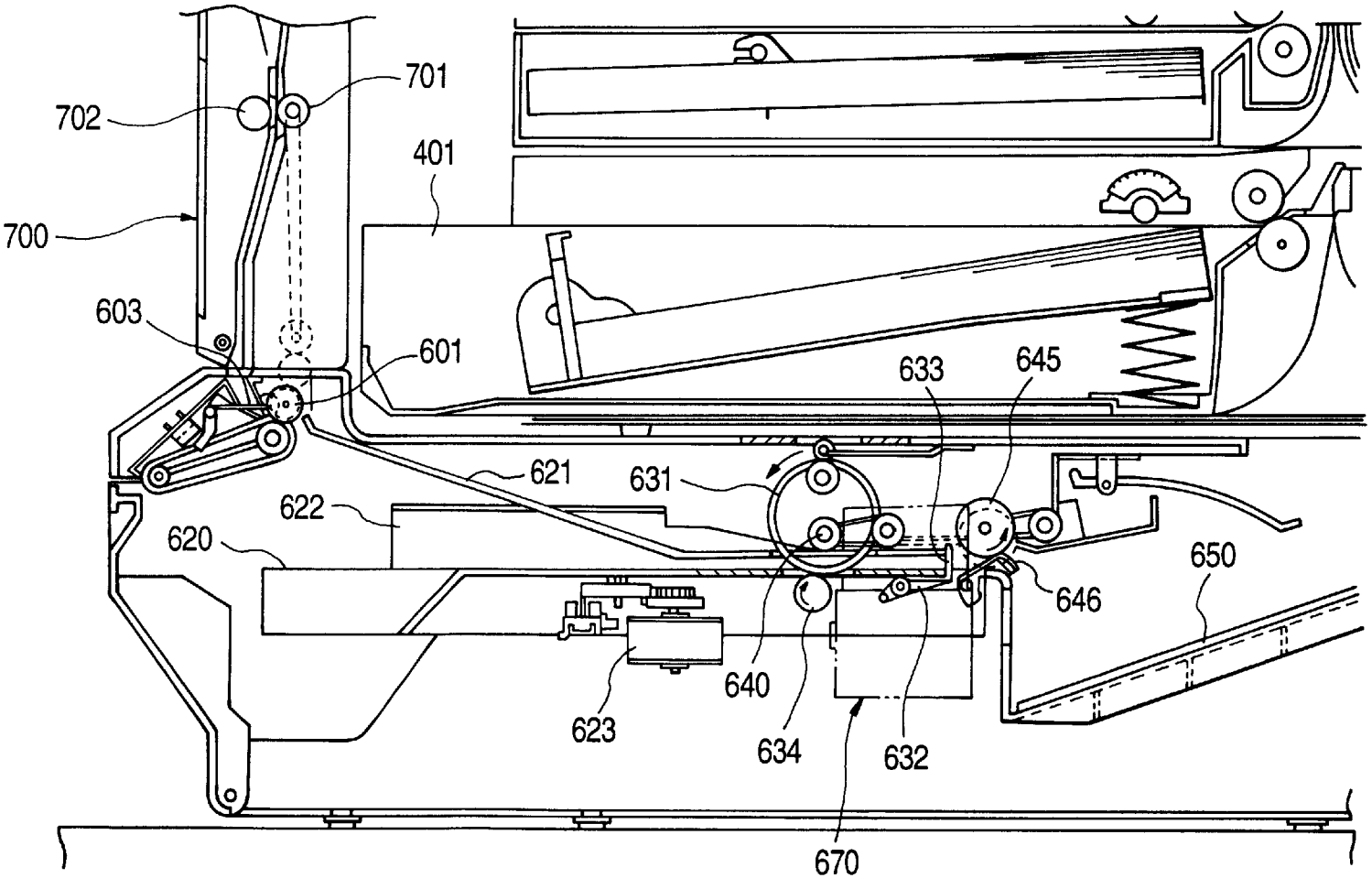
FIG. 4 is a front sectional view showing the vicinity of the discharged sheet stacking apparatus of FIG. 3.

As shown in FIGS. 3 and 4, since the vertical convey portion 700 is provided at a position which does not interfere with the sheet cassette 401 protruded from the printer body 101, the vertical convey portion is spaced apart from the outer surface of the printer body 101. The sheet passed through the extension guide 800 and conveyed in the vertical convey portion 700 is fed in a sheet aligning portion by a vertical convey roller 701, a convey sub-roller 702 rotatingly biased against the vertical convey roller 701, an align feed-in roller 601 of the discharged sheet stacking apparatus 600 and an align feed-in sub-roller 602 rotatingly biased against the align feed-in roller 601 (step S1003).

In this case, since the sheet on which the image was formed in the face-up fashion in the printer 100 is conveyed through below the printer body 101, the sheet is conveyed in a so-called face-down fashion (with imaged surface facing downwardly).

Further, an align feed-in sensor 603 disposed at an upstream side of a nip between the align feed-in roller 601 and sub-roller 602 detects a timing for feeding the sheet in and a timing the tail end of the sheet leaves.

After the sheet feeding-in timing is detected, when a predetermined time period is elapsed, the align feed-in sensor 603 serves to drive a lateral registration align plate 622 (described later) or to drive a shutter 632 or to detect sheet jam.

The aligning portion according to the first embodiment of the present invention is constituted by the align feed-in roller 601, an upper guide 621, an align table 620, a vertical align belt 631, and the shutter 632.

The sheet P conveyed by the align feed-in roller 601 is guided by the upper guide 621 and align table 620 and is moved until the tip end of the sheet abuts against a tip end stopper portion 633 of the shutter 632 (which is now in an operated condition (step S1005)) by the vertical align belt 631 for aligning the sheet in a right direction in FIG. 3.

Figure 1:
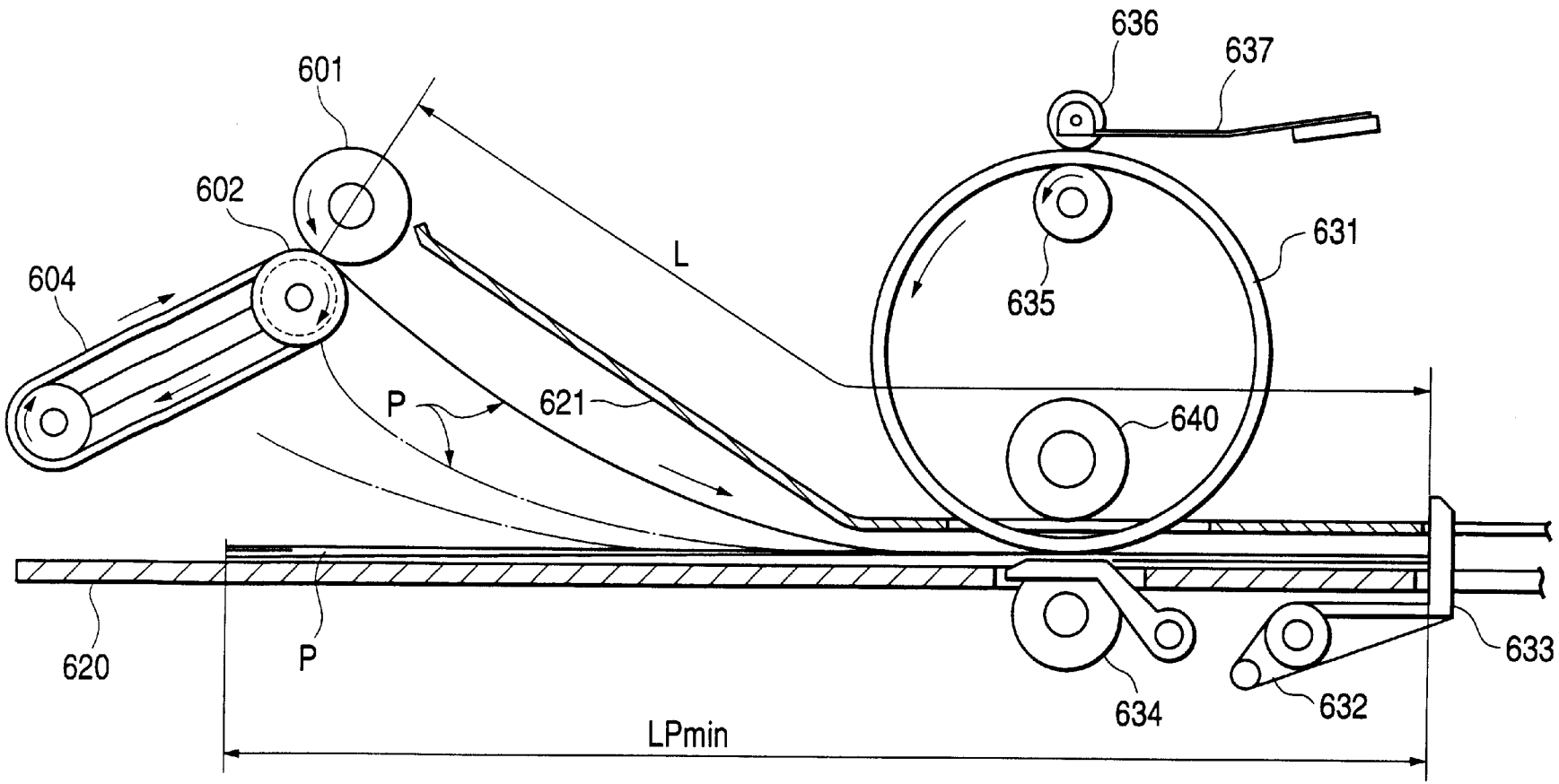
FIG. 1 is a detailed front view of an aligning portion of a discharged sheet stacking apparatus according to a first embodiment of the present invention.

In this case, when it is assumed that a distance of a sheet convey guide length (defined by the upper guide 621 and the like) from a nip between the align feed-in roller 601 and the align feed-in sub-roller 602 rotatingly urged against the align feed-in roller 601 with predetermined force is L, and a minimum sheet size length of the sheet used in the discharged sheet stacking apparatus is LPmin, as shown in FIG. 1, the following relation is satisfied:

$$L<LPmin.$$

For example, if the sheet used in the discharged sheet stacking apparatus has LTR size (279 mm), the value is selected to be about 275 to 270 mm.

Further, the sheet guide member constituted by the upper guide 621 and the align table 620 is narrower in an up-and-down direction to suppress curl and deformation of the sheet in the vicinity of the downstream shutter 632 and wider in the up-and-down direction immediately at the downstream side of the upstream align feed-in roller 601.

Further, in a left-and-right direction, between the align feed-in roller 601 and the shutter 632, the vertical align belt 631 is rotatingly driven by an align belt drive roller 635 and a sub-roller 636 biased against the align belt drive roller 635 by means of a sub-roller spring 637, thereby applying a small conveying force in the sheet conveying direction.

Thus, the sheet P is pinched between and conveyed by the align feed-in roller 601 and the align feed-in sub-roller 602 rotatingly biased against the align feed-in roller 601 by means of a spring (not shown), and the tip end of the sheet abuts against the shutter 632 by the conveying forces of the roller 601 and the sub-roller 602. As a result, the sheet is urged by the vertical align belt 631 while the tip end of the sheet is always being urged against the shutter 632 by the convey guide comprised of upper guide 621 and the align table 620, and the vertical align belt 631.

In this case, since the distance L between the align feed-in roller 601 and the shutter 632 is greater than the length of the sheet, the tail end of the sheet is conveyed while forming a loop.

Figure 2:
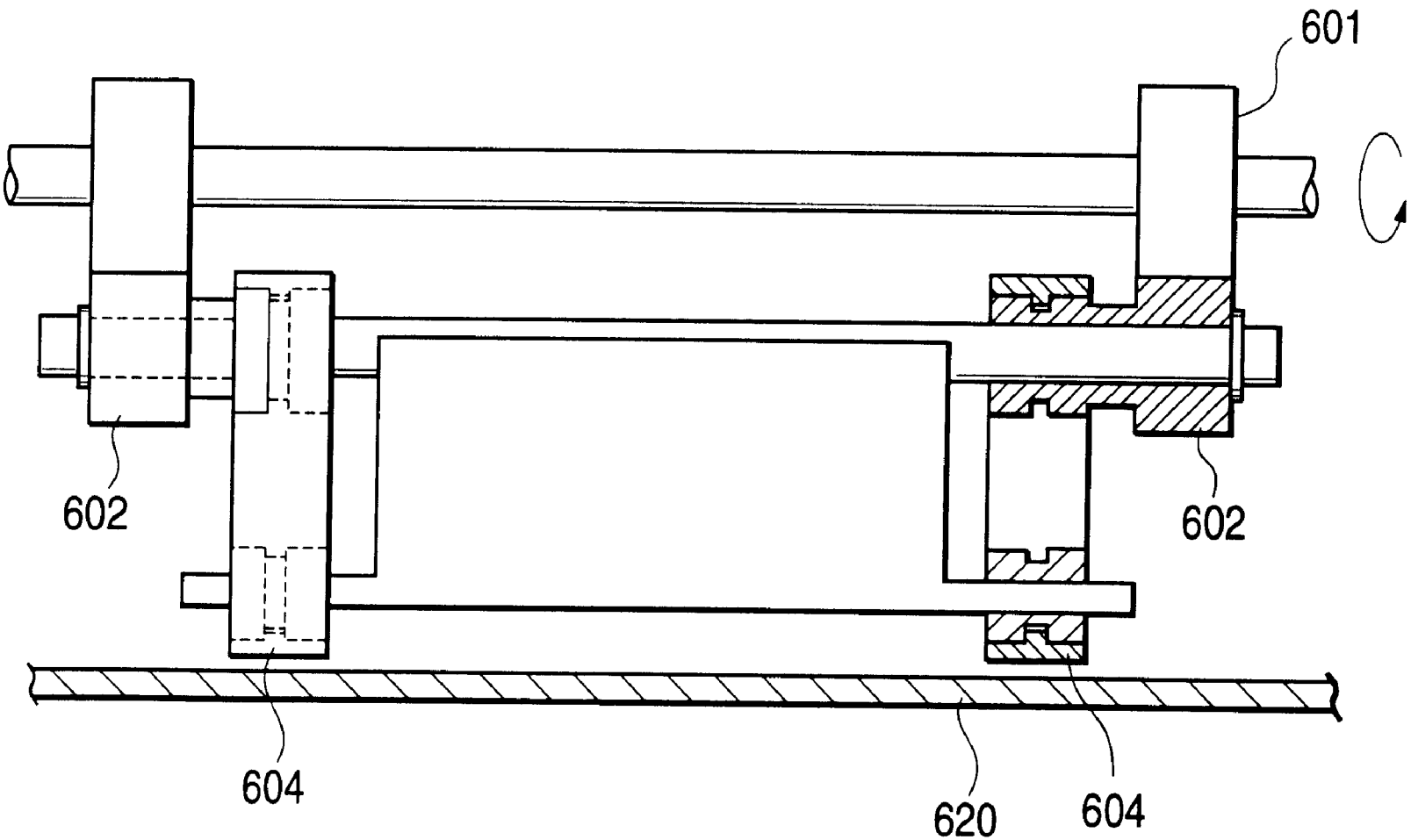
FIG. 2 is a left side view of the apparatus of FIG. 1.

On the other hand, as shown in FIG. 2, since an endless ejecting belt 604 for ejecting the tail end of the sheet is mounted on a shaft of the align feed-in sub-roller 602, when the align feed-in sub-roller 602 is rotated by the align feed-in roller 601, in synchronous with this, the endless ejecting belt 604 is also rotated in the same direction as the align feed-in sub-roller 602.

Thus, the sheet P in which the loop is formed by the align feed-in roller 601 and the align feed-in sub-roller 602 is gradually stacked on the align table 620 while smoothly absorbing the loop by the ejecting belt 604 in a condition that the sheet abuts against the shutter 632. That is to say, as shown in FIG. 1, the loop formed in the tail end portion of the sheet P becomes great at the time when the sheet is pinched and conveyed by the align feed-in roller 601 and the align feed-in sub-roller 602. However, since the endless ejecting belt 604 is inclined away from the shutter 632 as the belt goes downwardly, the tail end of the sheet P is separated from the endless ejecting belt 604 gradually as the sheet is dropped. As a result, the loop in the sheet P is gradually decreased. In this way, since the loop is formed in the tail end of the sheet P even during the dropping of the sheet P, the tip end of the sheet P is always urged against the shutter 632.

In this case, depending upon the kind of the sheet, some sheet has great rigidity to create great reaction force during the formation of the loop. However, such reaction force is absorbed by flexion of the endless ejecting belt 604. In the illustrated embodiment, the belt is formed from rubber having hardness of about 45° to 55°.

After the tip end of the sheet abuts against the shutter 632, although the vertical align belt 631 continues to rotate in the sheet pulling direction, since the conveying force of the belt is small, the buckling of the sheet and the push-down of the shutter 632 can be avoided.

Actually, the conveying force of the vertical align belt 631 is selected to afford a force of about 5 to 10 grams to the sheet.

At the time when several sheets are stored, if the discharged sheet stacking apparatus 600 does not receive staple command (step S1005), a bundle feeding roller 640 is lowered (step S1020). Then, the shutter is opened (step S1021) and the bundle feeding roller 640 is driven (step S1022). Thereafter, a sheet discharging roller 645 is lowered (step S1023) to cooperate with the rotating bundle feeding roller 640, thereby discharging the sheet to a stacking portion 650.

When the discharged sheet stacking apparatus 600 receives the staple command (step S1005), at a timing in which the tail end of the sheet P leaves the align feed-in roller 601 and the tip end of the sheet P abuts the shutter 632, a lateral registration aligning motor (stepping motor) 623 drives a lateral registration aligning plate 622, thereby aligning the conveyed sheet P in a lateral direction (step S1007). Meanwhile, the tail end of the sheet P is separated from the endless ejecting belt before the lateral alignment of the sheet P is effected, and is stacked on the align table 620. The lateral registration aligning plate 622 retarded to a position retarded from the sheet feeding-in position by a predetermined amount is controlled by the lateral registration motor 623 so that it can be shifted by a distance slightly smaller than a predetermined width of the sheet P conveyed. When the lateral registration aligning plate 622 is pushed in the position smaller than the width of the sheet, the sheet is flexed and a reaction force is transmitted to a sheet urging portion of the lateral registration aligning plate 622.

Between the lateral registration aligning plate 622 and a rack gear meshed with a drive pinion gear of the lateral registration motor 623 to be driven thereby, there is play or gap in the sheet width-wise direction. The lateral registration aligning plate 622 is always biased by a spring member (not shown) to a position for making the width of the sheet narrower within the gap so as to absorb the reaction force of the sheet. Since the play or gap is selected to be greater than an amount for which the lateral registration aligning plate 622 is pushed in the position smaller than the width of the sheet, when the reaction force of the sheet exceeds a predetermined value, the sheet aligning portion of the lateral registration aligning plate 622 is overcome by the reaction force of the sheet, with the result that the lateral registration aligning plate is maintained to the width of the sheet within the play or gap.

The sheet bundle obtained by aligning a predetermined number of sheets in the aligning portion in this way is subjected to a stapling process by a staple unit 670 shown in FIG. 4 (step S1010).

The movement of the stapling portion when the stapling is effected in one position differs from the movement of the stapling portion when the stapling is effected in plural position. Now, the movement of the stapling portion in each case will be explained.

Figure 5:
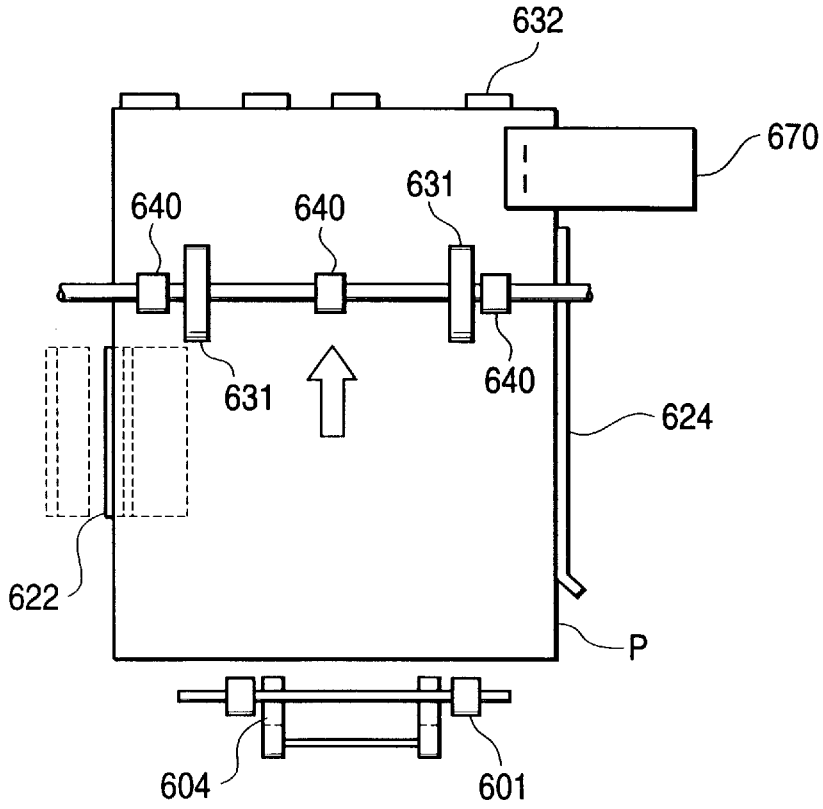
FIGS. 5 and 6 are explanatory views showing a stapling process of the discharged sheet stacking apparatus of FIG. 1.

As shown in FIG. 5, the staple unit 670 is disposed rightwardly and upwardly with respect to the sheets stacked (with imaged surfaces facing downwardly) in the conveying direction so that corners of the sheet bundle can be stapled by the staple unit.

Thus, when only one corner of the aligned sheet bundle is stapled, first of all, the lateral registration aligning plate 622 is pushed in the position smaller than the width of the sheet and then is slightly returned from the aligning position (urging the sheet bundle against a reference plate 624) to the sheet width position, and, the lateral registration aligning plate is held at this position while the lateral registration motor 623 is energized (step S1017). Thereafter, the staple unit 670 is driven to effect the stapling operation, thereby stapling the sheet bundle (step S1018).

Then, the lateral registration aligning plate 622 is shifted to the open position to release the lateral regulation (step S1019), and the bundle feeding roller 640 is lowered (step S1020) by a rotary arm to permit the conveyance of the sheet bundle. In this way, the sheet bundle stapled by the staple unit 670 is pinched between the bundle feeding roller and a roller 634 provided on the align table 620. Thereafter, the shutter 632 is opened (step S1021) and the bundle feeding roller 640 is rotatingly driven (step S1022), so that the sheet bundle is discharged onto the stacking portion 650. In this case, normally, a sheet discharging roller 645 is also lowered by a lift/lower mechanism (not shown) (step S1023) to convey and discharge the sheet bundle. Incidentally, since the driving of the discharging roller 645 is not released even when this roller is in a waiting position, the discharging roller is always rotated.

Figure 6:
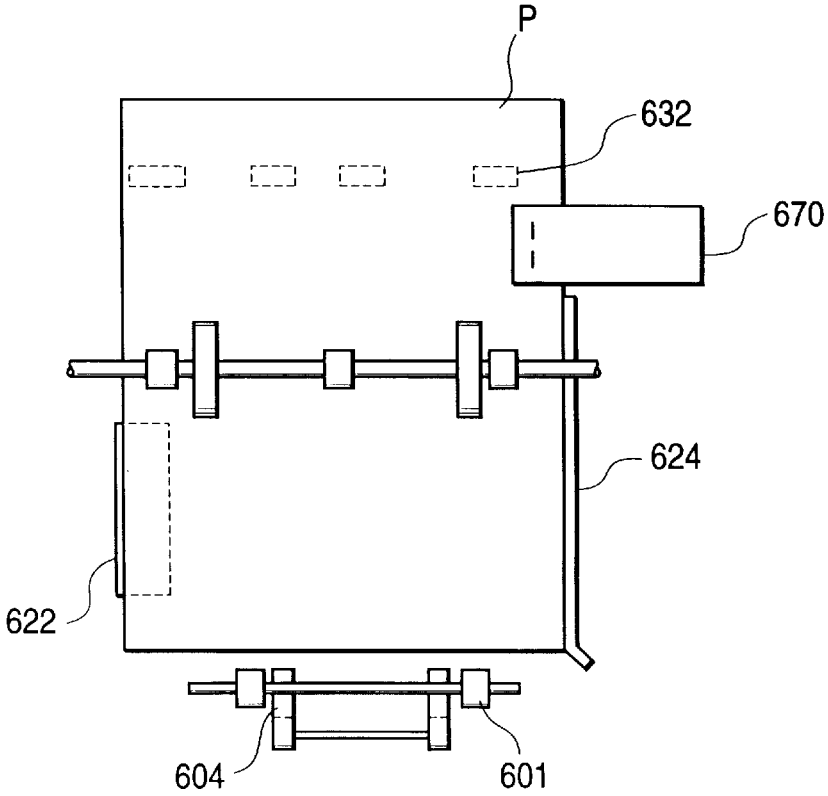

When the aligned sheet bundle is stapled at two or more positions, as shown in FIG. 6, since the sheet bundle is stapled at positions spaced apart from the longitudinal center line of the sheet (rather than the corner of the sheet bundle), the stapled positions are different from the stapled position regarding the one-position stapling. Accordingly, a control method for plural-position stapling differs from the control method for the one-position stapling. When the sheet bundle is stapled at plural positions after the shutter is opened, the sheet bundle is conveyed to the stapling position where the stapling is effected.

First of all, the lateral registration aligning plate 622 is returned from the position smaller than the sheet width to the sheet width position, and, then, the bundle feeding roller 640 is lowered (step S1012) to pinch the sheet bundle between the bundle feeding roller and the opposed bundle feeding back-up roller 634. Then, after the shutter 632 is opened (step S1013), the bundle feeding roller 640 and the bundle feeding back-up roller 634 are driven to convey the sheet bundle to a predetermined position (step S1014).

Thereafter, the feeding rollers are stopped, and the stapling is effected in a condition that the pressure is applied to the sheet bundle (step S1015).

In order to staple the sheet bundle at the second position and so on, after the stapling, the bundle feeding roller 640 is shifted to a predetermined position, and then, the stapling is effected when the sheet bundle is nipped in the condition that the roller 640 is stopped. This operation is repeated by required times (steps S1014, S1015).

After the stapling treatment is finished (step S1016), the lateral registration aligning plate 622 is shifted away from the sheet width position (step S1024), and the bundle feeding roller 640 and the bundle feeding back-up roller 634 are driven (step S1022), and the waiting sheet discharging roller 645 is lowered to the conveyance permitting position (step S1023), thereby conveying and discharging the sheet bundle onto the stacking portion 650.

In FIG. 4, a discharge sheet sensor flag 646 serves to detect sheet jam in the sheet discharging portion.

In FIG. 3, a full stack detecting means 660 serves to detect the fact that the discharged and stacked sheets reach a predetermined stacking height, thereby preventing further stacking, malfunction of the apparatus and damage of the stacked sheets.

Figure 7:
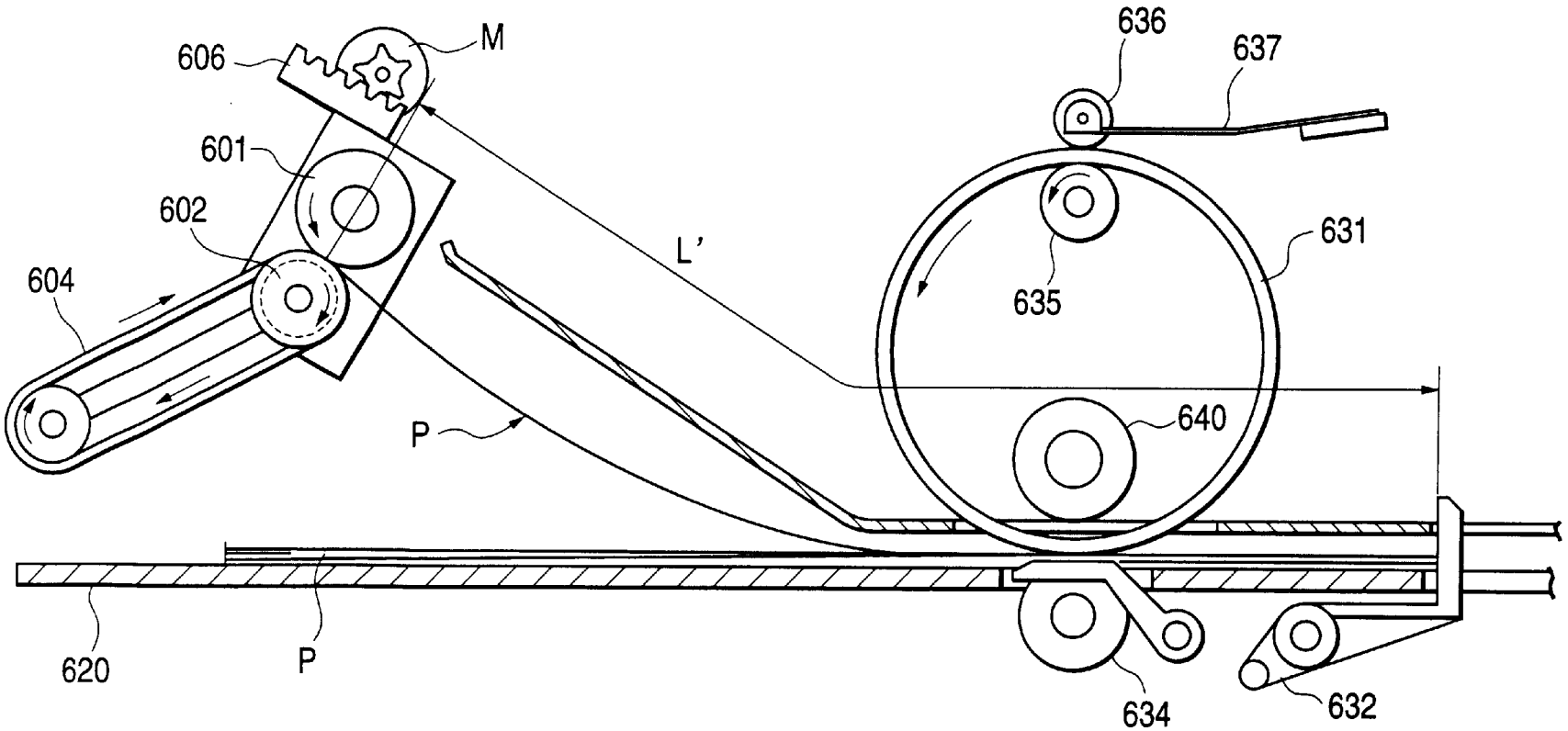
FIG. 7 is a detailed front view of an aligning portion of an alternate discharged sheet stacking apparatus according to the first embodiment of the present invention.
Figure 8:
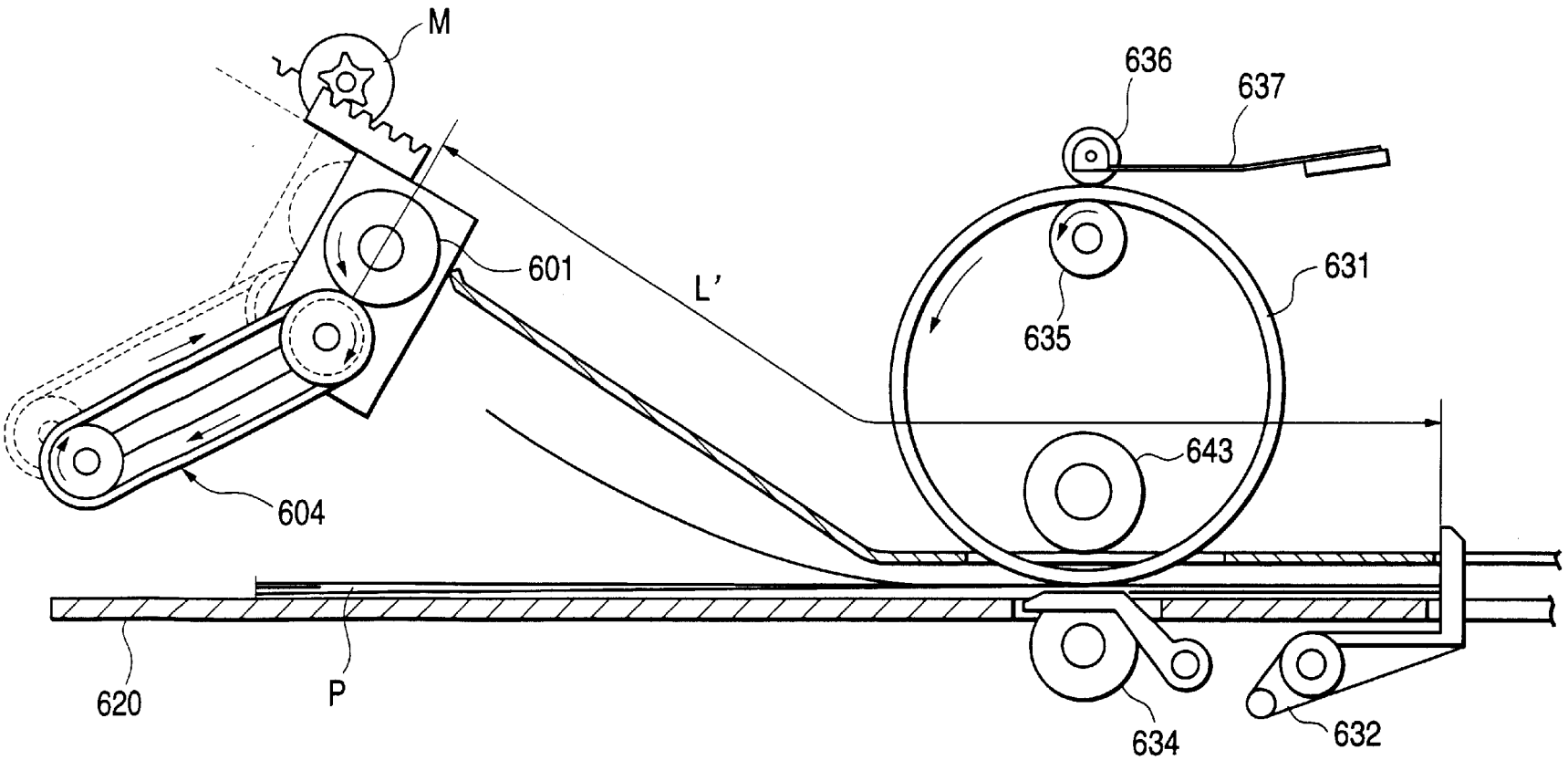
FIG. 8 is a view for explaining an operation of the apparatus of FIG. 7.

FIGS. 7 and 8 show an alteration of the first embodiment of the present invention. In a discharged sheet stacking apparatus according to this alteration, the align convey-in roller 601, align convey-in sub-roller 602 and endless ejecting belt 604 are constituted as a unit, and the unit is provided with a rack 606 so that the unit can be shifted by a motor M through the rack. By providing the shiftable align convey-in unit in this way, a distance L' is made variable so that many kinds of sheets having various sizes can be handled.

The shift positions of the unit may automatically be determined on the basis of sheet signals from the printer 100 or may be determined on the basis of a result that a length of the sheet is detected by a sensor in the convey path.

Figure 9:
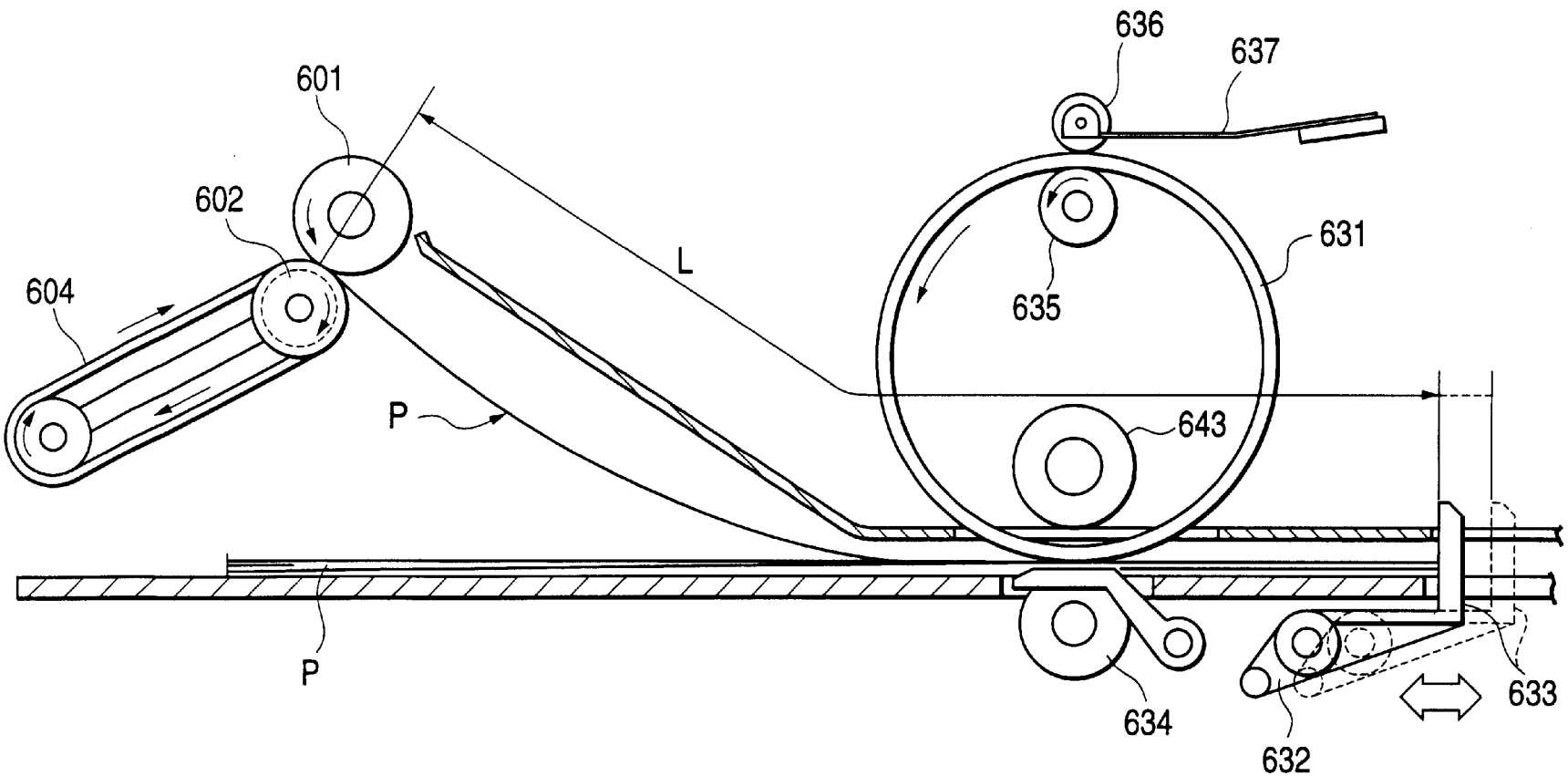
FIG. 9 is a detailed front view of an aligning portion of a further alternate discharged sheet stacking apparatus according to the first embodiment of the present invention.

FIG. 9 shows a further alteration of the first embodiment of the present invention. In a discharged sheet stacking apparatus according to this alteration, the shutter 632 against which the sheet abuts is made shiftable, so that a predetermined loop can be formed in the sheet P conveyed in accordance with a sheet size. In this way, by using the shiftable shutter, many kinds of sheets having various sizes can be handled, with simple arrangement. Of course, the shutter 632 may automatically be shifted in response to a signal from the printer or sheet size information from upstream sensors.

Further, in the illustrated embodiment, while an example that the endless ejecting belt 604 is used as a means for biasing the tail end of the sheet was explained, any arrangement in which the sheet can be dropped while biasing the tail end of the sheet may be used.

Figure 13:
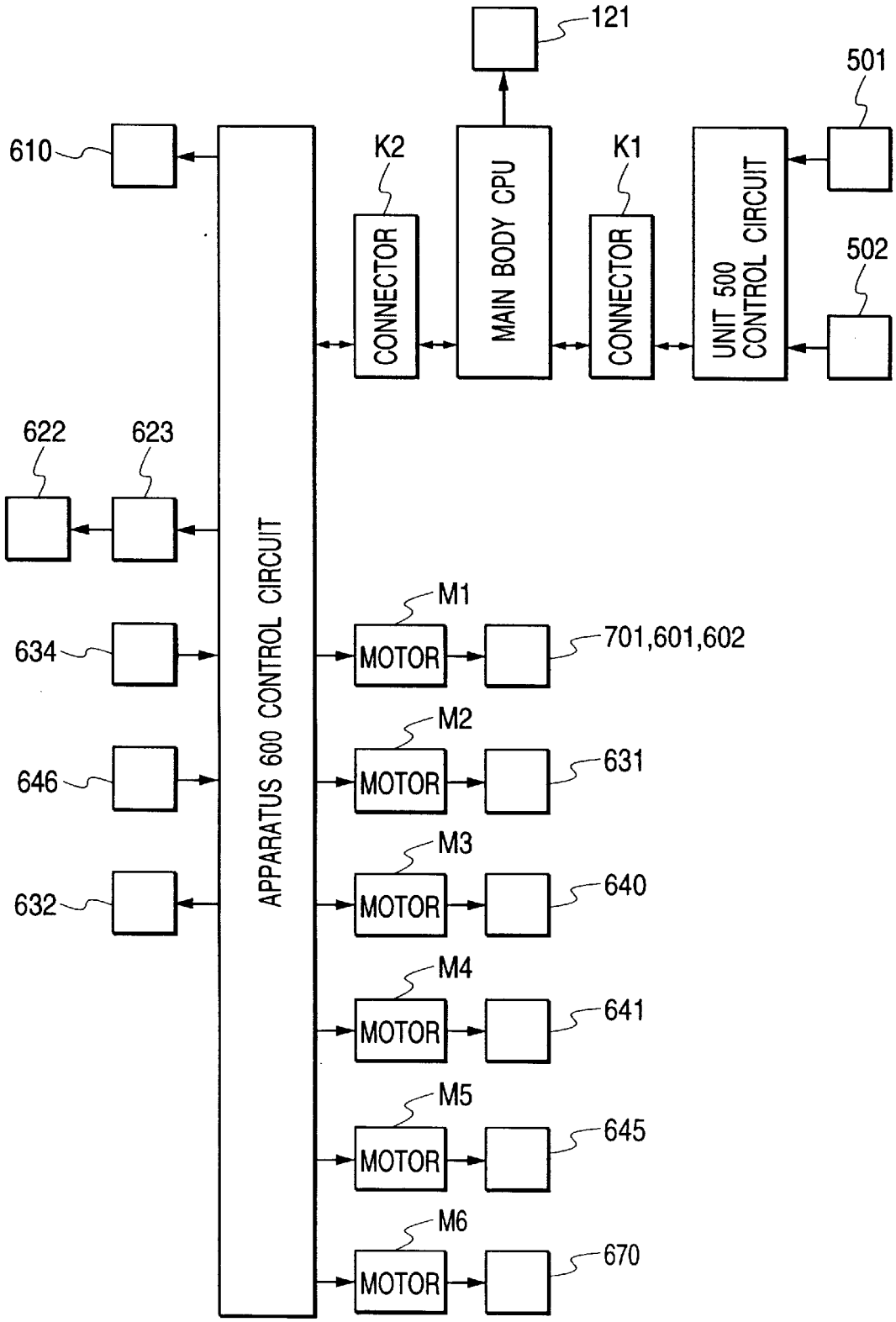
FIG. 13 is a block circuit diagram of the printer of FIG. 12.

In FIG. 13, a connector K1 serves to connect a CPU in the printer body 101 to a control circuit for the both-face unit 500.

A connector K2 serves to connect a control circuit for the discharged sheet stacking apparatus 600 to the CPU in the printer body 101.

Motors M1 to M6 connected to the control circuit for the discharged sheet stacking apparatus 600 serve to drive rollers 701, 601, 640, 641, 645, sub-roller 602, belt 631, and staple unit 670.

[Second Embodiment]

Figure 14:
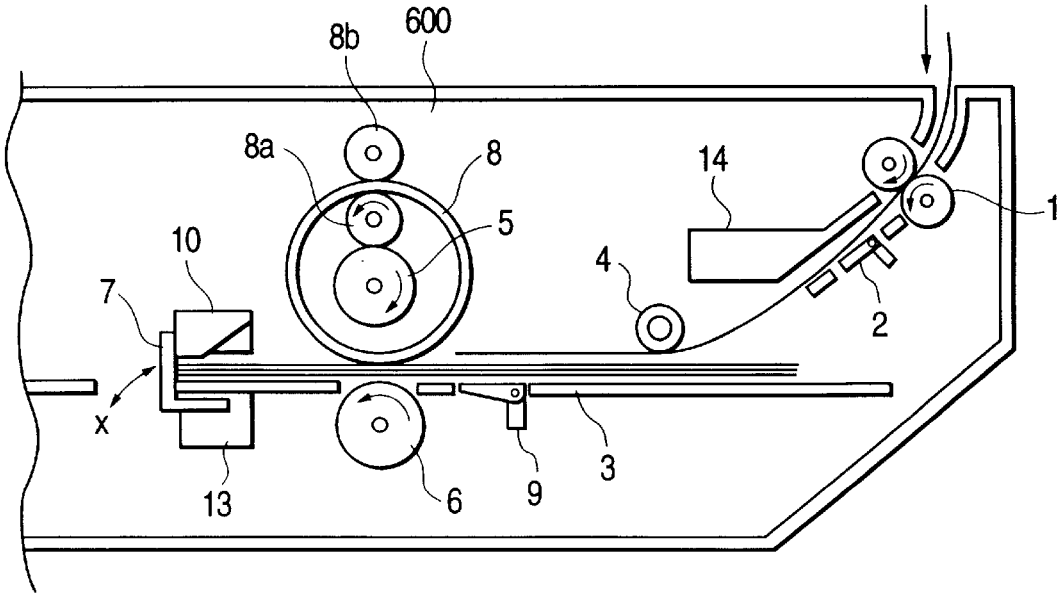
FIG. 14 is a sectional view of a discharged sheet stacking apparatus according to a second embodiment of the present invention.

The sheet P to which a toner image formed on a photosensitive drum 101 of the printer 100 was transferred is conveyed to a discharged sheet stacking apparatus 600 shown in FIG. 14. In this discharged sheet stacking apparatus 600, sheets P conveyed from the printer through a vertical convey portion 700 and an extension guide portion 800 are bundled in a sheet aligning portion and are stapled in one or more positions.

Figure 17:
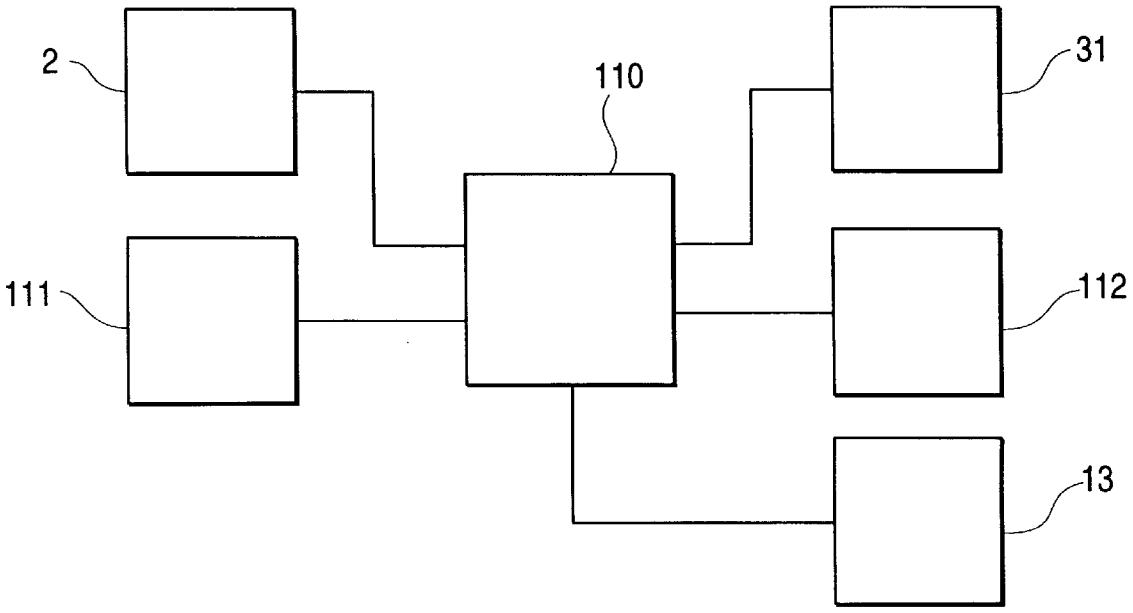
FIG. 17 is a control block diagram of the discharged sheet stacking apparatus according to a second embodiment of the present invention.

The discharged sheet stacking apparatus 600 is provided with a pair of align feed-in rollers 1 disposed at an inlet for the sheet P conveyed from the vertical convey portion 700, as shown in FIG. 14. An align feed-in sensor (detecting means) 2 for detecting the sheet P entering into the discharged sheet stacking apparatus 600 is disposed in the vicinity of the pair of align feed-in rollers 1. The align feed-in sensor 2 serves to detect a feeding-in timing of the sheet P and to drive an align shifting wall (aligning member) 12 (described later) through a CPU 111 shown in FIG. 17 after a predetermined time period is elapsed. Further, the align feed-in sensor 2 is associated with an opposed upper guide 14 for guiding conveyance of the sheet P. The sheets P passed through the align feed-in sensor 2 are aligned on a sheet stacking tray (sheet stacking portion) 3. The sheet stacking tray 3 is provided with a sheet detecting sensor (sheet presence/absence detecting means) 9 for detecting presence/absence of the sheet P, and a curl suppressing lever 10 for preventing the sheets P stacked on the sheet stacking tray 3 from the floating due to curl or the like.

Figure 15:
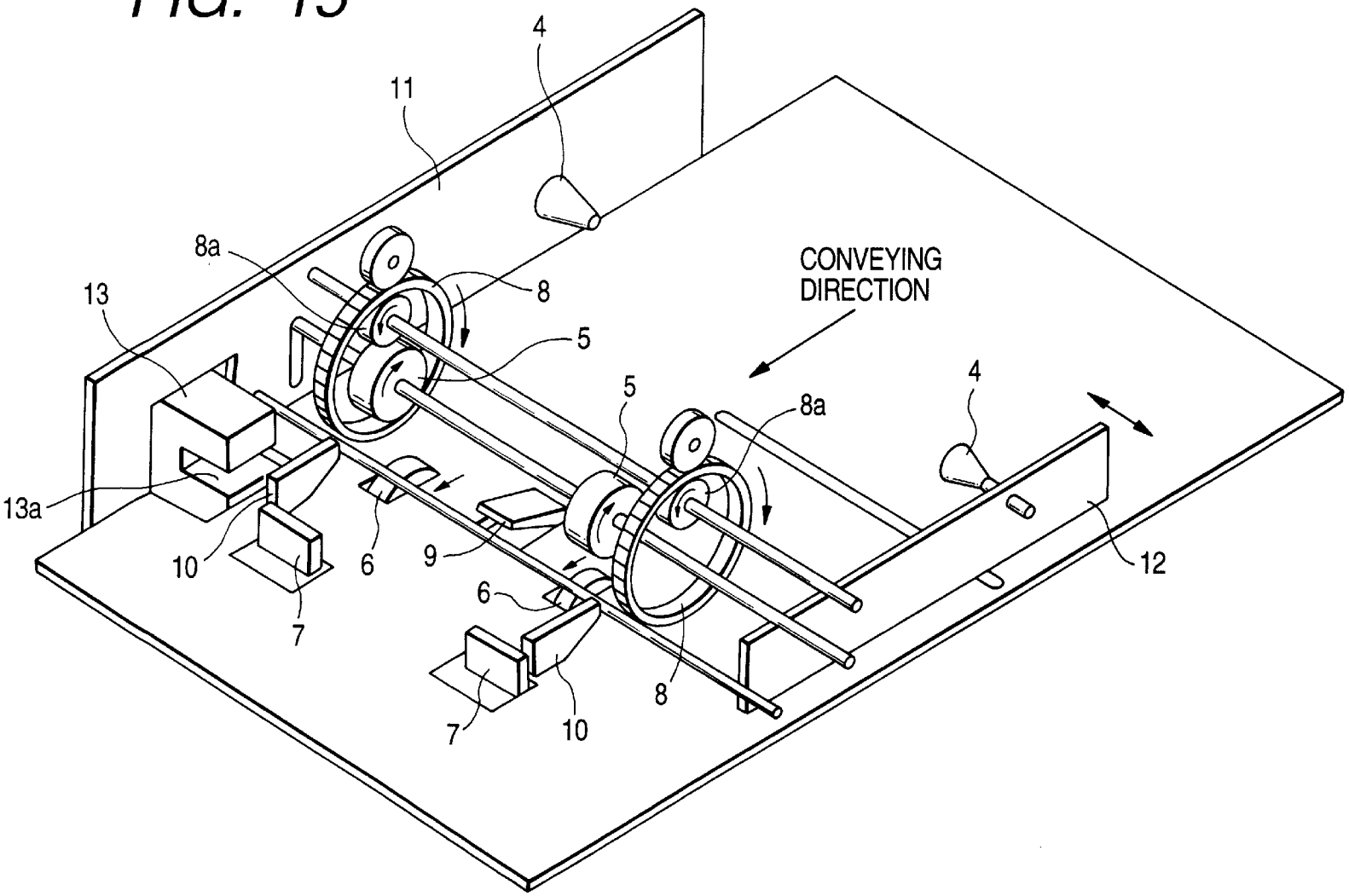
FIG. 15 is a perspective view of the discharged sheet stacking apparatus according to a second embodiment of the present invention.

As shown in FIGS. 14 and 15, the sheet aligning portion includes the align feed-in sensor 2 for detecting the sheet P conveyed to the discharged sheet stacking apparatus 600, an align reference wall (aligning member) 11 which is formed uprightly from the sheet stacking tray 3 and against which one lateral edge of the sheet P abuts, an L-shaped align movable wall 12 movable toward and away from the align reference wall 11 and opposed to the align reference wall 11 with the interposition of the sheet P and provided at its bottom with a locking portion 12*a* and adapted to align the sheets in a width-wise direction, a sheet stopper 7 for aligning tip ends of the sheets P conveyed to the sheet stacking tray 3 by the pair of align feed-in rollers 1, and a plurality of ring-shaped vertical align belt 8 rotatingly driven by drive rollers 8*a* (contacted with inner surfaces of the belts) to urge the tip end of the sheet P against the sheet stopper 7 and co-axially arranged along the width-wise direction of the sheet P. Incidentally, when the CPU 110 recognizes the fact the a predetermined number of sheets P set by a setting key 111 are counted by a counter 112, the sheet stopper 7 is rotatingly driven by a clutch (not shown) so that the stopper can be shifted a sheet stop position and a retard position (i.e., retractable with respect to the sheet stacking tray 3). Further, a driven roller 8*b* rotatably supported by a leaf spring (not shown) is contacted with an outer surface of each vertical align belt 8 and is opposed to the corresponding drive roller 8*a*, so that each vertical align belt 8 is rotated while being pinched between the corresponding driven and drive rollers 8*b*, 8*a*.

Figure 16:
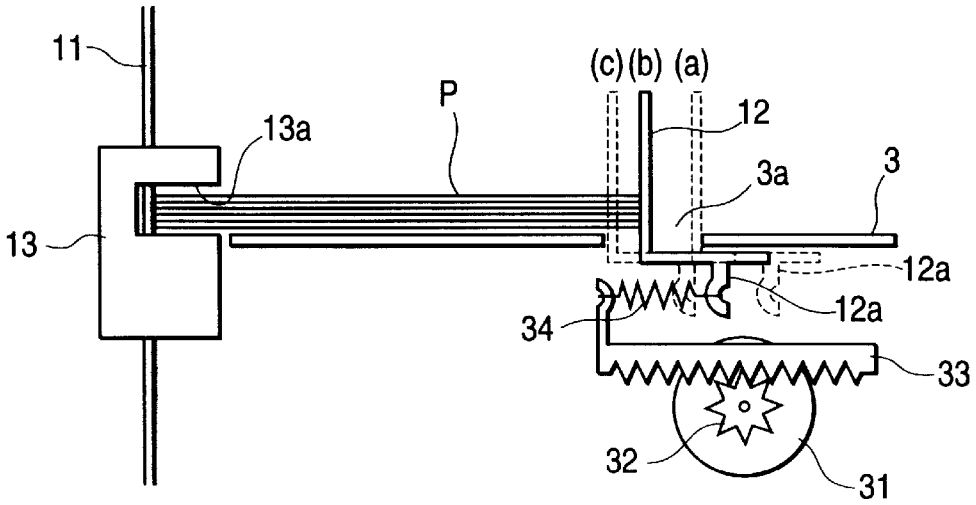
FIG. 16 is a sectional view for explaining an aligning operation of the discharged sheet stacking apparatus according to a second embodiment of the present invention.

Further, as shown in FIG. 16, the sheet stacking tray 3 has a slit 3*a* (formed therein) along which the align movable wall 12 is shifted. The locking portion 12*a* formed on the bottom of the align movable wall 12 is slidably fitted into the slit 3*a*. Between the locking portion 12*a* and a rack 33 meshed with a drive pinion 32 supported on a shaft 31*a* of a drive motor (drive means) 31 to receive a driving force from the pinion, there is provided a spring 34, in being tensioned condition, biased to make the width of the sheet P narrower. With this arrangement, the align movable wall 12 can be shifted in the width-wise direction of the sheet stacking tray 3 due to expansion and contraction of the spring 34 effected by the rack 33 shifted by rotation of the drive pinion 32. That is to say, the sheet aligning portion has a function that, whenever each sheet P is stacked on the sheet stacking tray 3 between the align reference wall 11 and the align movable wall 12, the align movable wall 12 urges the lateral edge of the sheet P against the align reference wall 11 to align the sheet bundle in the width-wise direction. The other lateral edge of the sheet P pushed by the align movable wall 12 abuts against the align reference wall 11, thereby aligning the lateral edges of the sheets.

Further, the discharged sheet stacking apparatus 600 is provided with conical sub-rollers 4 rotatably supported by the align reference wall 11 and the align movable wall 12 and adapted to suppress the curl of the sheet P in the width-wise direction, and a plurality of rockable rollers 5 co-axially supported along the width-wise direction of the sheet P. Each rockable roller 5 is supported for up-and-down movement at a predetermined timing by a corresponding clutch (not shown). In a confronting relation to the rockable rollers 5, there are provided convey rollers 6 protruded from the sheet stacking tray 3. The rockable rollers 5 and the convey rollers 6 are rotatingly driven in synchronous with each other by means of drive motors (not shown). The align movable wall 12 is associated with a drive motor 31 so that the align movable wall can be shifted toward and away from the align reference wall 11 while maintaining parallelism between these walls. Incidentally, the align movable wall 12 can be positioned by using a cam.

A stapler unit (sheet bundle stapling means) 13 for stapling the sheet bundle with staples is secured at a tip end of the sheet aligning position in parallel with the align reference wall 11. The stapler unit 13 has a concave stapler portion 13*a* into which the staple is protruded. The stapler unit 13 is designed to effect the stapling operation while the sheet bundle is being passed through the stapler portion 13*a*. Thus, the stapler unit 13 effects the stapling operation without shifting in the conveying direction of the sheet P. Incidentally, the stapler unit 13 is controlled b the CPU 110 in such a manner that, after the sheet bundle is shifted to a predetermined position by the rockable rollers 5 and the convey rollers 6.

Now, an operation of the discharged sheet stacking apparatus having the above-mentioned construction will be explained.

The toner image formed on the photosensitive drum 101 of the printer 100 is transferred onto the sheet at a transfer position. The sheet to which the toner image was transferred is guided and conveyed to the inlet of the discharged sheet stacking apparatus 600 by a pair of discharge rollers and a pair of vertical convey rollers 701.

The sheet P conveyed in the discharged sheet stacking apparatus 600 is conveyed along the upper guide 14 by the pair of align feed-in rollers 1. When the passage of the sheet P is detected by the align feed-in sensor 2, a detection signal is sent to the CPU 110 which drives the align movable wall 12 after a predetermined time period is elapsed.

The sheet P is conveyed by the pair of align feed-in rollers 1 and is passed through below the conical sub-rollers 4 while suppressing the curl and then is conveyed onto the sheet stacking tray 3. The sheet P on the sheet stacking tray 3 is conveyed toward a downstream direction in the conveying direction by small conveying forces of the vertical align belts 8 to abut against the sheet stopper 7, thereby aligning the tip end (in the conveying direction) of the sheet. Since the conveying forces of the vertical align belts 8 for conveying the sheet P are selected to be small, the buckling of the sheet P urged against the sheet stopper 7 can be prevented and the sheet stopper 7 protruded from the sheet stacking tray 3 at the sheet stop position can be prevented from being rotated to the retard position. Further, since the rockable rollers 5 are waiting at an elevated position and the convey rollers 6 are not rotated, the sheet P conveyed by the vertical align belts 8 is slid on the sheet stacking tray 3 or on the sheet stack rested on the sheet stacking tray 3. That is to say, the tip ends (in the conveying direction) of the sheets P are aligned with each other by the conveying forces of the vertical align belts 8.

Next, alignment of the sheet s P in the width-wise direction perpendicular to the conveying direction will be explained.

After the fact that the sheet P is conveyed onto the sheet stacking tray 3 is detected by the align feed-in sensor 2, when a predetermined time period is elapsed, the CPU 110 drives the drive motor 31 to shift the align movable wall 12.

The alignment of the sheets P in the width-wise direction is effected whenever each sheet P is stacked on the sheet stacking tray 3. The align movable wall 12 can be shifted between (a) retard position, (c) aligning position and (b) conveying position. That is to say, a position where a distance between the align reference wall 11 and the align movable wall 12 is greater than the width of the sheet is the retard position (a), and a position where the distance between the align reference wall 11 and the align movable wall 12 is smaller than the width of the sheet is the aligning position (c), and a difference between the aligning position (c) and the width of the sheet is smaller than a gap of the slit 3*a* through which the align movable wall 12 can shift. Further, a position where the distance between the align reference wall 11 and the align movable wall 12 is substantially equal to the width of the sheet is the conveying position (b). When the sheet P is conveyed to the sheet stacking tray 3, the align movable wall positioned in the retard position (a) urges each sheet P against the align reference wall 11, thereby aligning the sheets P in the width-wise direction. In this case, the align movable wall 12 is overlapped up to the aligning position (c) where the distance between the align reference wall 11 and the align movable wall 12 becomes smaller than the width of the sheet, tolerance of the width of the sheet P is absorbed, thereby abutting the sheet P against the align reference wall 11 positively.

As mentioned above, the alignment of the sheet in the width-wise direction is effected whenever each sheet is conveyed onto the sheet stacking tray 3, and this is repeated until the predetermined number of sheets set by the setting key 111 as the sheet bundle and counted by the counter 112 are stacked on the sheet stacking tray 3. The sheet bundle obtained in this way is stapled.

Next, the stapling operation for the sheet bundle will be explained.

Since the stapler unit 13 is secured at the position rightwardly and upwardly in the sheet conveying direction in parallel with the align reference wall 11, by effecting the stapling operation at that position, the corner of the sheet bundle can be stapled. Accordingly, when only one corner of the sheet bundle P is stapled, the stapling operation is effected at the position where the sheets P are aligned, without shifting the aligned sheet bundle. Thereafter, the rockable rollers 5 are lowered to pinch the sheet bundle between the rockable rollers 5 and the convey rollers 6, and the sheet stopper 7 is retarded to the retard position shown by the arrow x. As a result, the conveyance of the sheet bundle is permitted. The sheet bundle is conveyed by the rockable rollers 5 and the convey rollers 6 to be discharged out of the discharged sheet stacking apparatus 600.

When the sheet bundle is stapled in two or more positions, the sheet bundle must be shifted to the stapling position. That is to say, after the alignment of the sheet bundle is completed, the rockable rollers 5 are lowered to pinch the sheet bundle between the rockable rollers and the convey rollers 6. Thereafter, the sheet stopper 7 is retarded to the retard position to permit the conveyance of the sheet bundle. Then, the sheet bundle is conveyed by the rockable rollers 5 and the convey rollers 6.

In this case, since the sheet bundle is pinched between the rockable rollers 5 and the convey rollers 6 positively, the alignment of the sheets in the sheet bundle in the conveying direction is not distorted. Further, during the conveyance of the sheet bundle, since the align movable wall 12 is located at the conveying position (b) where the distance between the walls is substantially equal to the width of the sheet, the alignment of the sheets in the sheet bundle in the direction perpendicular to the conveying direction can be maintained. Further, since the align movable wall 12 is not located at the aligning position where the distance between the walls is smaller than the width of the sheet, while the sheet bundle is being conveyed, resistance of the align reference wall 11 and the align movable wall 12 can be minimized.

The sheet bundle conveyed by the predetermined distance is stopped by stopping the rotations of the rockable rollers 5 and the convey rollers 6. Then, the stapling operation is effected without shifting the stapler unit 13 at all. Thereafter, the sheet bundle is conveyed again to the next stapling position to effect the next stapling operation. In this way, all stapling operations are performed. After the stapling is completed, the sheet bundle is discharged from the discharged sheet stacking apparatus 600.

As mentioned above, in the condition that the stapler unit 13 is not shifted at all, the highly aligned sheets P can be stapled by shifting the sheet bundle without distorting the alignment of the sheet bundle. Thus, the mechanism portion of the stapler unit 13 and the entire image forming apparatus can be simplified.

Figure 18:
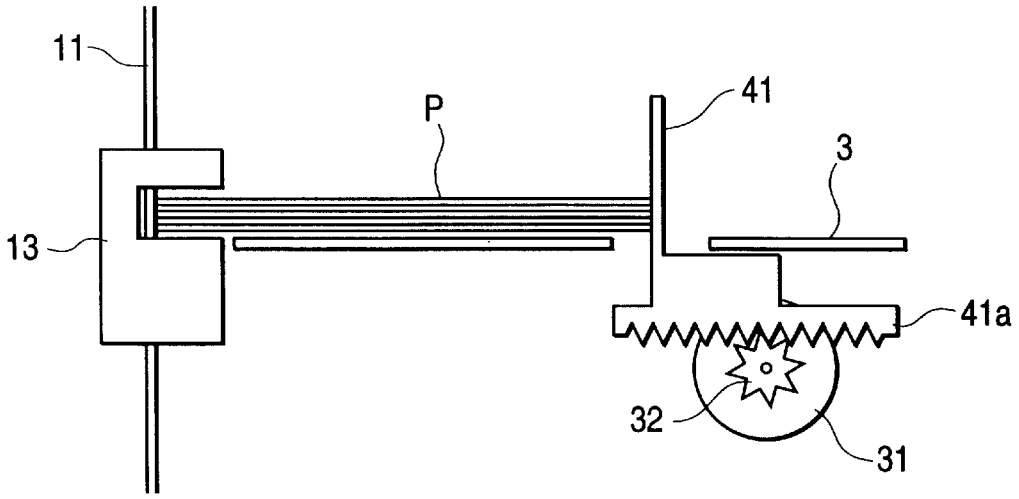
FIG. 18 is a sectional view for explaining an aligning operation of an alternate discharged sheet stacking apparatus according to the second embodiment of the present invention.

FIG. 18 is a sectional view for explaining an aligning operation of a discharged sheet stacking apparatus according to an alteration of the second embodiment. In a sheet bundle stapling mechanism according to this alteration, a distance between an align movable wall 41 and an align reference wall 11 can be changed freely. That is to say, positions of the align movable wall 41 are stored in a memory (not shown) so that an aligning position (for aligning), a conveying position (for bundle-conveying) and a retard position of the align movable wall 41 can be set for each kind of sheet. Data are read out from the memory by the CPU 110, and, on the basis of the data, rotation of the drive motor 31 is controlled. In this way, the distance between the align movable wall 41 and the align reference wall 11 can be changed freely to accommodate to the kind of the sheet. By doing so, regardless of rigidity, thickness and/or size of each sheet, fine-adjustment by means of a spring can be omitted. Accordingly, the spring itself can be omitted, and, by forming a rack 41*a* integrally with the align movable wall 41, the number of parts can be reduced. Further, since the align movable wall 41 has no play, alignment of the sheet bundle and conveyance of the sheet bundle can be performed more accurately than the apparatus using the spring, thereby improving alignment of the sheets.

Figure 19A:
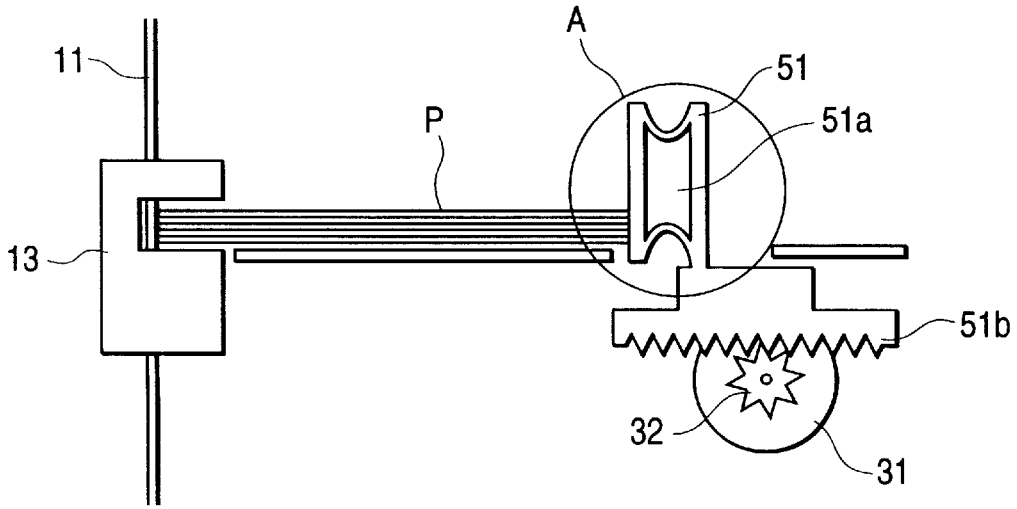
FIG. 19A is a sectional view for explaining an aligning operation of a further alternate discharged sheet stacking apparatus according to the second embodiment of the present invention.
Figure 19B:
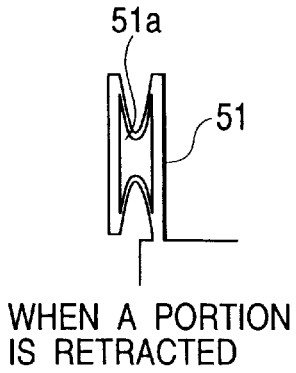
FIG. 19B is an enlarged view showing a portion A in FIG. 19A.

FIG. 19A is a sectional view for explaining an aligning operation of a discharged sheet stacking apparatus according to a further alteration of the second embodiment, and FIG. 19B is an enlarged view of a portion A in FIG. 19A. In this alteration, a spring mechanism 51*a* is provided at an end of an align movable wall 51 against which the sheet bundle abuts. Further, similar to the above-mentioned alteration, positions of the align movable wall 51 are stored in a memory so that an aligning position, a conveying position and a retard position of the align movable wall 51 can be set for each kind of sheet, and, on the basis of the data from the memory, the drive motor 31 is rotated. Further, the align movable wall 51 is formed integrally with a rack 51*b* so that the number of parts of the spring mechanism 51*a* is reduced.

[Third Embodiment]

Next, a third embodiment of the present invention will be explained.

Figure 21:
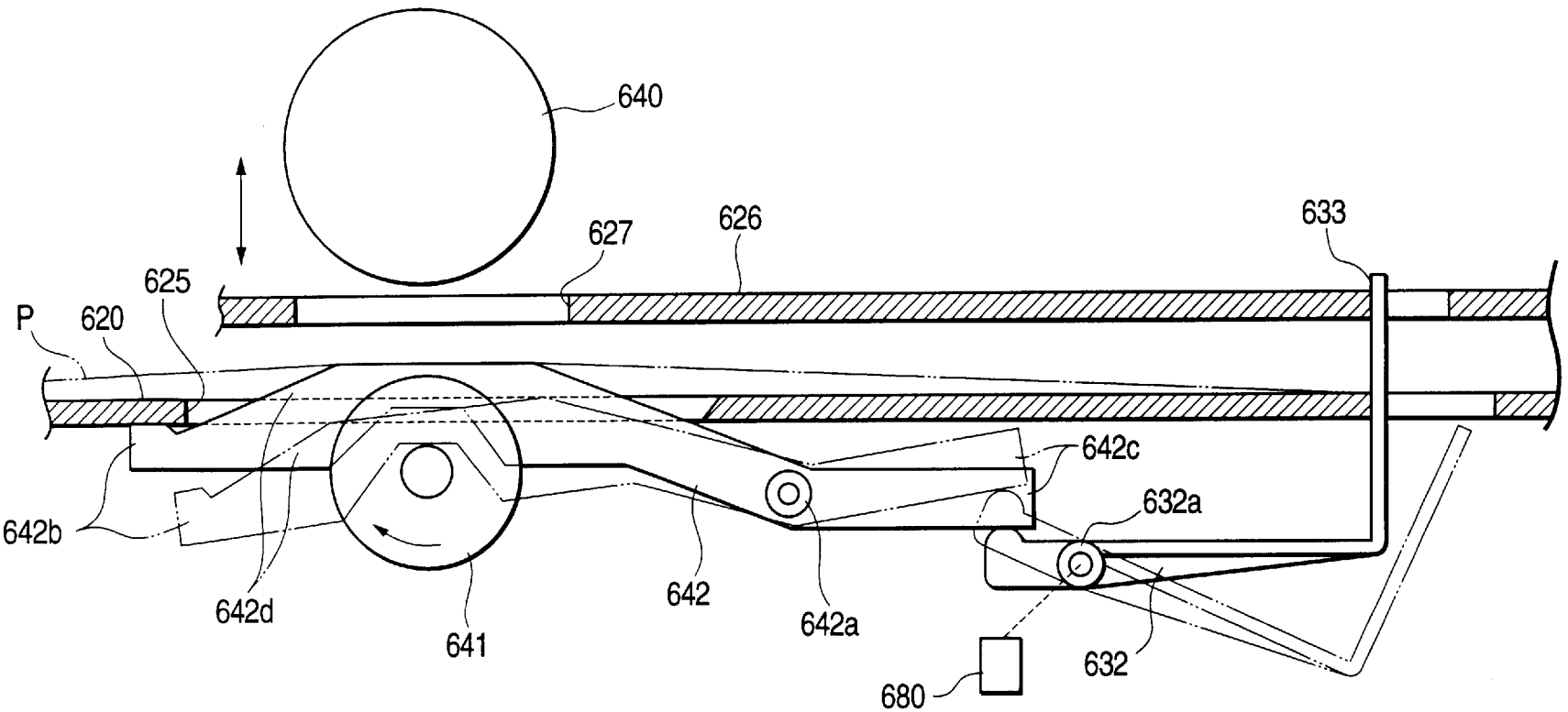
FIG. 21 is a front sectional view showing main portions of a discharged sheet stacking apparatus according to a third embodiment of the present invention.
Figure 22:
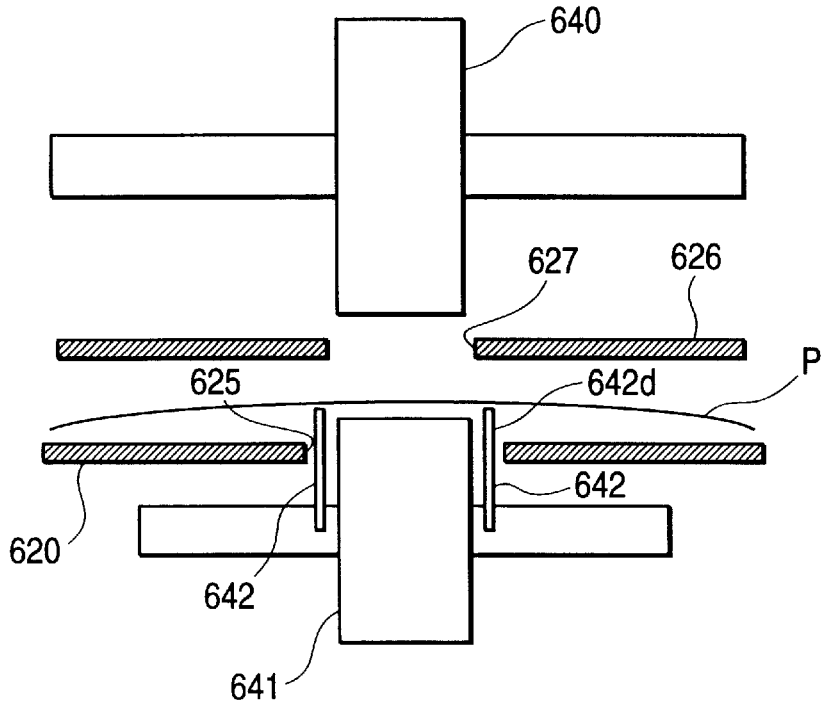
FIG. 22 is a left side sectional view of the apparatus of FIG. 21.
Figure 23:
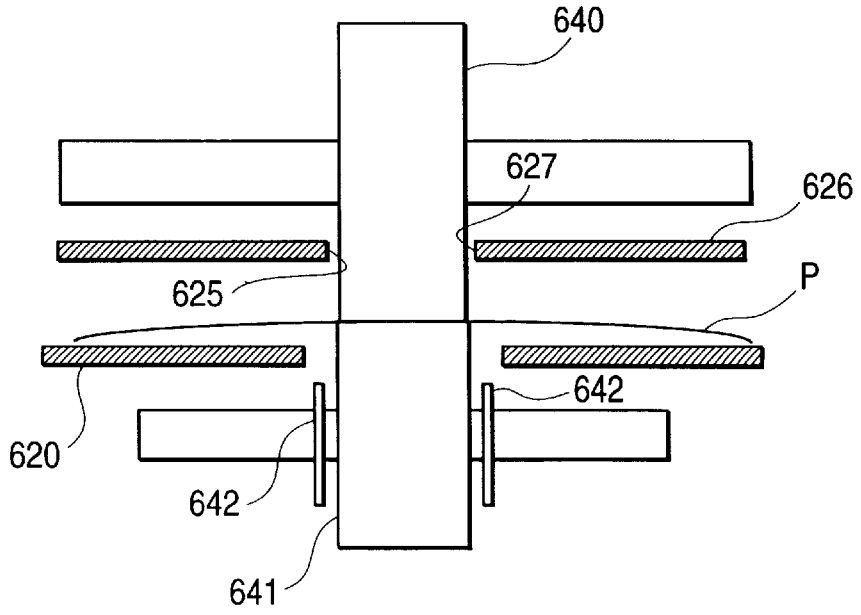
FIG. 23 is a view showing a condition that a sheet is pinched by a pair of sheet convey rollers in FIG. 21.

FIG. 21 is a partial sectional view showing the vicinity of an align table (sheet stacking portion) 620. FIGS. 22 and 23 are sectional views of the align table 620 in a width-wise direction. In FIG. 21, the solid line shows a condition that sheets are stacked (stored) on the align table 620, and the two dot and chain line shows a condition that a sheet bundle is discharged.

A guide member (sheet receiving member) 642 comprises a pair of ink pieces supported on a fulcrum shaft 642*a* for tilting movement in an up-and-down direction on both sides of a bundle feeding roller 641 below the align table 620. One end 642*c* of the guide member 642 is adapted to abut against a sheet stopper 632 and the other end 642*b* is adapted to abut against the align table 620. An intermediate portion 642*d* of the guide member 642 between the fulcrum shaft 642*a* and the other end 642*b* is formed as a substantially arc shape to be apt to receive and discharge the sheet P and is protruded slightly above the lower bundle feeding roller 641 through a through hole 625 formed in the align table 620.

When the sheet P is fed onto the align table 620, the sheet rides over the intermediate portion 642*d* of the guide member and abuts against a tip end stopper portion 633 of the sheet stopper 632 and is rested on the align table 620 while being supported by the guide member 642. Although the lower bundle feeding roller 641 is always rotated, since this roller is not contacted with the sheet, the sheet is not damaged or an image formed on the sheet is not deteriorated.

In particular, when the lower bundle feeding roller 641 made of rubber to facilitate the conveyance of the sheet, if the sheet is rubbed by the roller, the sheet and the image may be damaged. However, since the feeding roller does not contact with the sheet, the sheet and the image are not damaged, without worsening the conveying force.

When a predetermined number of sheets are stacked on the align table 620 and a stapling operation is completed, the sheet stopper 632 is rotated around the fulcrum shaft 642*a* in a clockwise direction by an actuator 680 such as a motor, a plunger or the like up to a position shown by the two dot and chain line, thereby retracting the tip end stopper portion 633 below the align table 620. At the same time, due to rotation of the sheet stopper 632, the guide member 642 is rotated around the fulcrum shaft 642*a* in an anti-clockwise direction up to a position shown by the two dot and chain line, with the result that the intermediate portion 642*d* is shifted below the lower bundle feeding roller 641. When the guide member 642 is rotated in the anti-clockwise direction, an upper bundle feeding roller 640 is lowered and is passed through a through-hole 627 formed in sheet floating suppressing plate 626, thereby nipping the sheet bundle between the upper and lower bundle feeding rollers 640, 641. The sheet bundle is fed out by the pair of bundle feeding rollers 640, 641.

Figure 24:
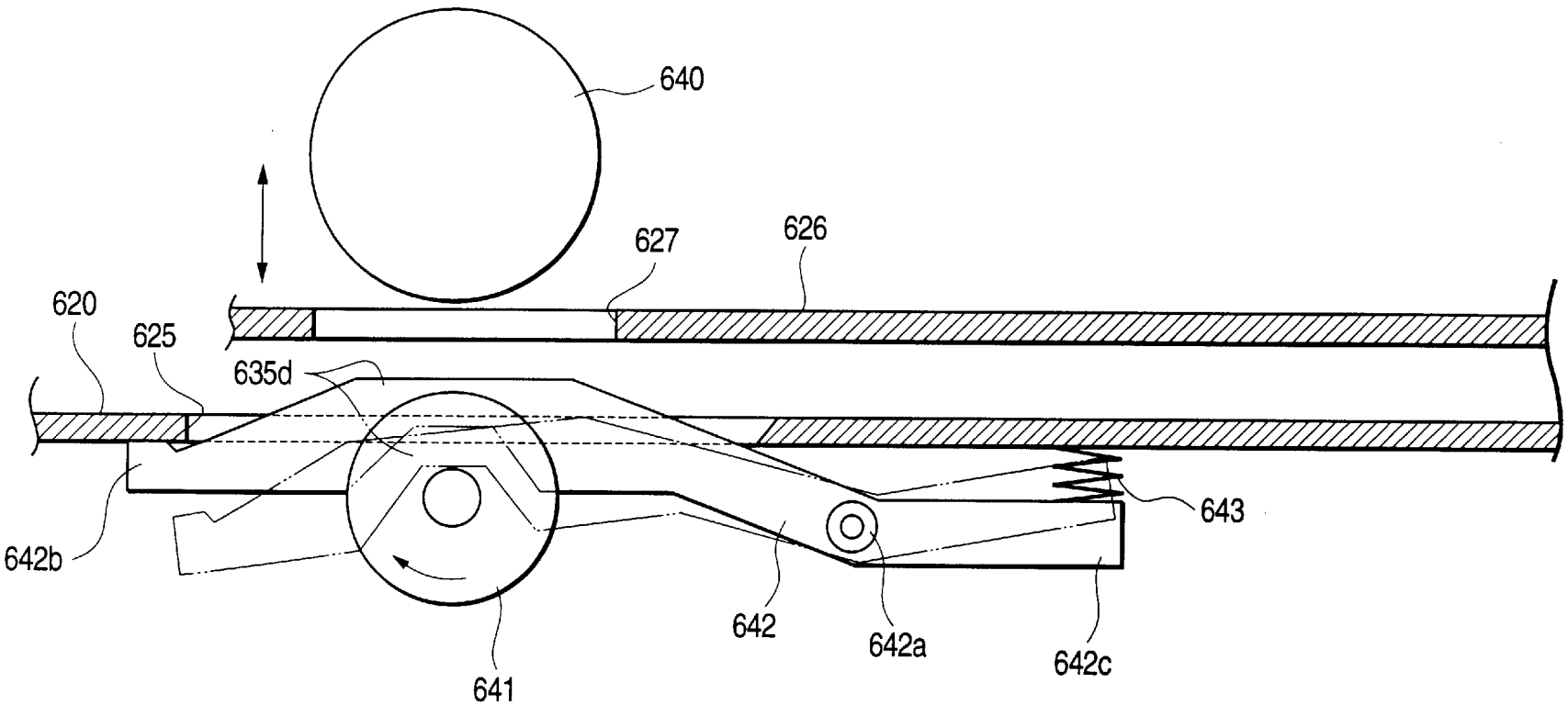
FIG. 24 is a front sectional view showing main portions of an alternate discharged sheet stacking apparatus according to the third embodiment of the present invention.

FIG. 24 shows an alteration of the third embodiment.

A guide member (sheet receiving member) 642 shown in FIG. 24 is a link piece, which is always biased in a clockwise direction by a compression spring (elastic body) 636 disposed between one end 642*c* and an align table 620, so that an intermediate portion 642*d* are protruded slightly above a lower bundle feeding roller 641.

When the sheet P is conveyed onto the align table 620, the sheet rides over the intermediate portion 642*d* of the guide member and abuts against a tip end stopper portion 633 of a sheet stopper 632 and is rested on the align table 620 while being supported by the guide member 642. Although the lower bundle feeding roller 641 is always rotated, since this roller is not contacted with the sheet, the sheet is not damaged or an image formed on the sheet is not deteriorated.

When a predetermined number of sheets are stacked on the align table 620, a stapling operation is performed, and an upper bundle feeding roller 640 is lower to push the sheet bundle and the guide member 642 downwardly in opposition to the compression spring 643, thereby pinching the sheet bundle between the upper and lower bundle feeding rollers 640, 641. The sheet bundle is fed out by the pair of bundle feeding rollers 640, 641.

Incidentally, although the sheet bundle is contacted with the intermediate portion 642*d* of the guide member 642 always rotatingly biased by the spring 643, since an elastic force of the spring 643 is selected to the extent that the guide member does not damage the sheet, when the sheet bundle is discharged, the sheet bundle is not damaged by the guide member 642.

Although the guide member 642 as mentioned above is disposed on both sides of the lower bundle feeding roller 641, the guide member may arranged at only one side of the lower bundle feeding roller. In this case, however, it is required that the protruded amount of the guide member is increased to prevent the lower bundle feeding roller 641 from contacting with the sheet.

Figure 25:
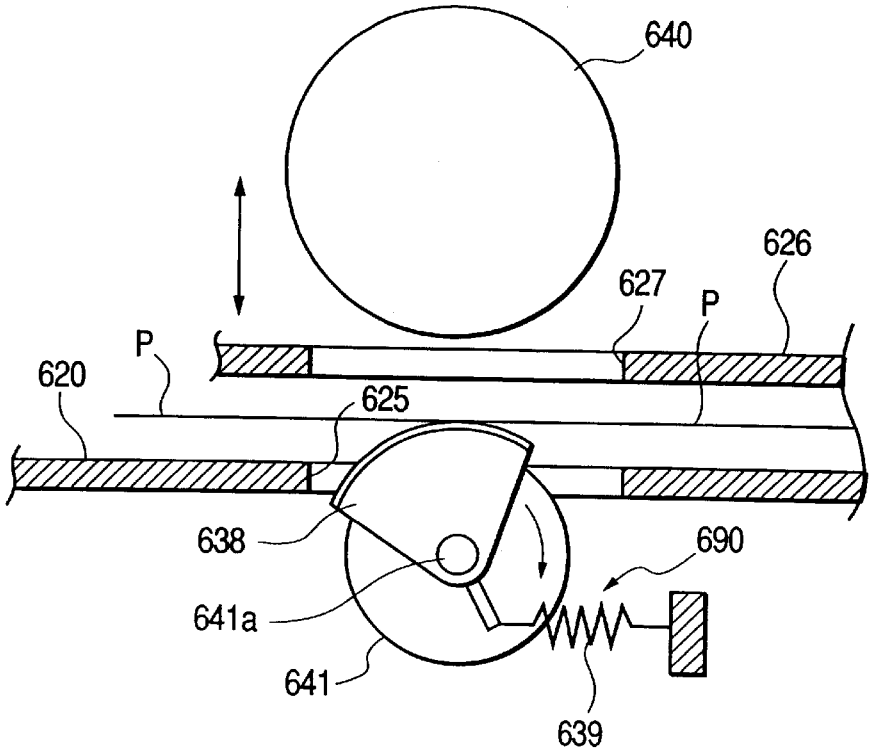
FIG. 25 is a front sectional view showing main portions of a further alternate discharged sheet stacking apparatus according to the third embodiment of the present invention.

FIG. 25 shows a further alteration of the third embodiment.

Figure 26:
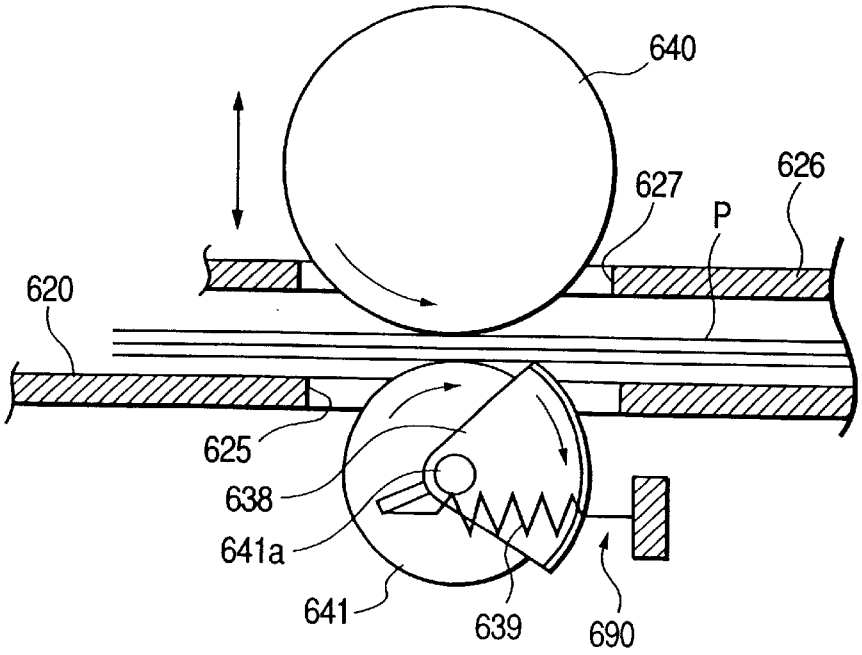
FIG. 26 is a view showing a condition that a sheet is pinched by a pair of sheet convey rollers in FIG. 25.

A roller cover means 690 shown in FIGS. 25 and 26 is constituted by a rotary cover 638 disposed co-axially with a rotary shaft 641*a* of a lower bundle feeding roller 641, and a tension spring (elastic body) 639 for rotatingly biasing the rotary cover toward a position above a portion of the lower bundle feeding roller 641 contacted with the sheet P.

Normally, the rotary cover 638 is formed as an inverted U-shape when looked at from the left in FIG. 25 to enclose or cover the lower bundle feeding roller 641 and is adapted to support the sheet P fed onto an align table 620. Although the lower bundle feeding roller 641 is always rotated, since this roller is not contacted with the sheet, the sheet is not damaged or an image formed on the sheet is not deteriorated.

After a predetermined number of sheets are fed onto the align table and the stapling operation is completed, when a tip end stopper portion 633 of a sheet stopper 632 is retracted below the align table 620, an upper bundle feeding roller 640 is lowered. The sheet bundle is pinched between the upper bundle feeding roller 640 and the rotary cover 638. When the upper bundle feeding roller 640 is rotated in an anti-clockwise direction, the sheet bundle is sent toward a discharging direction and the rotary cover 638 is rotatingly driven in a clockwise direction. When the upper bundle feeding roller 640 continues to rotate, the rotary cover 638 leaves between the sheet bundle and the lower bundle feeding roller 641. Thereafter, the sheet bundle is discharged while being pinched between the pair of bundle feeding rollers 640, 641. When the sheet bundle is discharged, the rotary cover 638 is returned to its initial position by the tension spring 639 to cover the upper portion of the lower bundle feeding roller 641 again, thereby preparing for next sheet conveyance.

Incidentally, in all of the above-mentioned embodiments and alterations, the lower bundle feeding roller 641 is not lifted and lowered, but only the upper bundle feeding roller 640 is lowered. The reason is that, if the lower bundle feeding roller 641 is lifted and lowered, the sheets stacked on the align table are lifted to deteriorate the alignment of the sheet bundle, with the result that undesired sheet bundle is obtained after the stapling.

According to the present invention, since the distance between the sheet feed-in means and the sheet stopper is smaller than the length of the sheet to be rested on the sheet stacking portion, in a condition that the sheet is urged against the sheet stopper with the loop formed in the sheet, such an urging condition can be kept. Thus, the discharged sheet stacking apparatus capable of achieving high alignment can be provided.

Further, according to the present invention, unlike to the conventional techniques, since the alignment of the sheets can be improved without including the sheet stacking portion, the discharged sheet stacking apparatus having a reduced height can be provided.

In addition, when the sheet auxiliary convey means is provided between the sheet feed-in means and the sheet stopper, since the conveyance of the sheet is aided to always achieve a condition that the sheet is urged against the sheet stopper, the alignment of the sheets can be improved with a simple construction.

As is in the present invention, in the case where the sheet auxiliary convey means is constituted by the endless belt, even when the sheet auxiliary convey means continues to rotate in the condition that the tip end of the sheet abuts against the sheet stopper, the conveying force of the sheet auxiliary convey means can be selected to prevent the buckling of the sheet and the opening of the sheet stopper.

As is in the present invention, when there is provided the biasing means for biasing the tail end of the sheet conveyed from the sheet feed-in means toward the conveying direction, the loop condition of the sheet formed by the sheet feed-in means is not released at once, but, is released gradually, with the result that the tip end of the sheet can be prevented from separating from the sheet stopper, thereby improving the alignment of the sheets.

As is in the present invention, in the case where the biasing means is constituted by the endless belt, since the belt can be flexed, the loop condition of the sheet is released, even in the sheet having great rigidity, the tail end of the sheet is positively received so that the tip end of the sheet is prevented from separating from the sheet stopper, thereby improving the alignment of the sheets.

Further, as is in the present invention, when the endless belt is designed so that the sheet is dropped while receiving the tail end of the sheet in a condition that the tip end of the sheet abuts against the sheet stopper, the alignment of the sheets can be improved.

Furthermore, according to the present invention, in the discharged sheet stacking apparatus, since there is provided the staple unit for stapling the sheets stacked on the sheet stacking portion, the highly aligned sheet bundle can be stapled to achieve good book-binding.

According to the present invention, since the image forming apparatus includes the discharged sheet stacking apparatus having reduced height and located below the image forming portion, the height of the entire image forming apparatus is reduced to facilitate the handling.

Further, according to the present invention, since the width-wise direction of the sheet conveyed onto the sheet stacking portion is aligned by the aligning members and the end of the sheet is aligned by the sheet stopper and the aligned sheet bundle is shifted to the stapling position by the convey means while pinching the sheet bundle from above and below and the sheet bundle is stapled by the stapling mechanism portion, a mechanism for shifting the stapling mechanism portion and a space therefor can be omitted. Accordingly, the entire apparatus can be simplified, and cost, installation space and power consumption can be reduced.

Further, since the drive means shifts the aligning member to the aligning position whenever the detecting means detects the fact that the sheet is conveyed to the sheet stacking portion and the aligning member is shifted to the conveying position when the sheet bundle is conveyed, the sheets conveyed to the sheet stacking portion can positively be aligned. Further, the sheet bundle aligned on the sheet stacking portion can be conveyed in the aligned condition. Accordingly, the sheet bundle can be conveyed positively without distorting the alignment of the sheet bundle in the conveying direction and in the direction perpendicular to the conveying direction, and the stapling can be effected without distorting the alignment of the sheet bundle.

Further, according to the present invention, while the sheets are being stored on the sheet stacking portion, since the sheet is supported by the sheet receiving member not to contact with one of the rollers, the sheet is not damaged by this one roller which is always rotated because the roller does not have drive connection/disconnection means such as a clutch for achieving simplification and cheapness of the discharged sheet stacking apparatus. Further, the image formed on the sheet is also not damaged.

As is in the present invention, when the storing means comprises the sheet stopper and the sheet receiving member comprises a link piece synchronous with the sheet stopper, the link piece is positively operated, and, while the sheet is being stored, the sheet is positively supported not to contact with one of the rollers, thereby preventing the damage of the sheet and/or the image.

As is in the present invention, when the sheet receiving member comprises a link piece protruded above one of the rollers by the elastic body, since the link piece can be retarded by being pushed by the other roller, the link piece supports the sheet positively not to contact with one of the rollers, thereby preventing the damage of the sheet and/or the image.

As is in the present invention, when there is provided the rotary cover rotatingly biased above one of rollers, since the rotary cover can be rotated to retard by the lowering the other roller, the rotary cover supports the sheet positively not to contact with one of the rollers, thereby preventing the damage of the sheet and/or the image.

According to the present invention, since the image forming apparatus includes the above-mentioned discharged sheet stacking apparatus, after the image is formed on the sheet, the sheet can be discharged while maintaining the good image quality.

What is claimed is:

1. A discharged sheet stacking apparatus comprising:

a sheet stopper;

sheet feed-in means disposed at a position spaced apart from said sheet stopper by a distance smaller than a length of the sheet for pinching and feeding a sheet onto a sheet stacking portion on which a plurality of sheets are stacked and for causing a tip end of the sheet to abut against same sheet stopper, wherein said sheet feed-in means continues the feeding operation while pinching a tail end of the sheet even after the tip end of the sheet abuts against said sheet stopper so that, after a loop is formed in the tail end of the sheet, the sheet is discharged onto said sheet stacking portion;

sheet stopper retracting means for retracting said sheet stopper from a position where the sheet on said sheet stacking portion abuts against said sheet stopper;

an aligning member for aligning the sheet in a sheet width-wise direction;

convey means for pinching a sheet bundle from above and below and for conveying the sheet bundle, in which the sheets are aligned in the sheet width-wise direction and the ends of the sheets are aligned by said sheet stopper; and control means for shifting the sheet bundle by said convey means to a stapling position where the sheet bundle is stapled by a stapling mechanism portion, after said sheet stopper is retracted by said sheet stopper retracting means.

2. A discharged sheet stacking apparatus comprising:

a sheet stopper;

sheet feed-in means disposed at a position spaced apart from said sheet stopper by a distance smaller than a length of the sheet for pinching and feeding a sheet onto a sheet stacking portion on which a plurality of sheets are stacked and for causing a tip end of the sheet to abut against said sheet stopper, wherein said sheet feed-in means continues the feeding operation while pinching a tail end of the sheet even after the tip end of the sheet abuts against said sheet stopper so that, after a loop is formed in the tail end of the sheet, the sheet is discharged onto said sheet stacking portion;

sheet auxiliary convey means provided between said sheet feed-in means and the sheet stopper for auxiliary conveying the sheet on said sheet feed-in means;

sheet stopper retracting means for retracting said sheet stopper from a position where the sheet on said sheet stacking portion abuts against said sheet stopper;

an aligning member for aligning the sheet in a sheet width-wise direction;

convey means for pinching a sheet bundle from above and below and for conveying the sheet bundle, in which the sheets are aligned in the sheet width-wise direction and the ends of the sheets are aligned by said sheet stopper; and control means for shifting the sheet bundle by said convey means to a stapling position where the sheet bundle is stapled by a stapling mechanism portion, after said sheet stopper is retracted by said sheet stopper retracting means.

3. A discharged sheet stacking apparatus comprising:

a sheet stopper;

sheet feed-in means disposed at a position spaced apart from said sheet stopper by a distance smaller than a length of the sheet for pinching and feeding a sheet onto a sheet stacking portion on which a plurality of sheets are stacked and for causing a tip end of the sheet to abut against said sheet stopper, wherein said sheet feed-in means continues the feeding operation while pinching a tail end of the sheet even after the tip end of the sheet abuts against said sheet stopper so that, after a loop is formed in the tail end of the sheet, the sheet is discharged onto said sheet stacking portion;

sheet auxiliary convey means provided between said sheet feed-in means and the sheet stopper for auxiliary conveying the sheet on said sheet feed-in means, wherein said sheet auxiliary convey means comprises an endless belt rotated in a sheet conveying direction;

sheet stopper retracting means for retracting said sheet stopper from a position where the sheet on said sheet stacking portion abuts against said sheet stopper;

an aligning member for aligning the sheet in a sheet width-wise direction;

convey means for pinching a sheet bundle from above and below and for conveying the sheet bundle, in which the sheets are aligned in the sheet width-wise direction and the ends of the sheets are aligned by said sheet stopper; and control means for shifting the sheet bundle by said convey means to a stapling position where the sheet bundle is stapled by a stapling mechanism portion, after said sheet stopper is retracted by said sheet stopper retracting means.

4. A discharged sheet stacking apparatus comprising:

a sheet stopper;

sheet feed-in means disposed at a position spaced apart from said sheet stopper by a distance smaller than a length of the sheet for pinching and feeding a sheet onto a sheet stacking portion on which a plurality of sheets are stacked and for causing a tip end of the sheet to abut against said sheet stopper, wherein said sheet feed-in means continues the feeding operation while pinching a tail end of the sheet even after the tip end of the sheet abuts against said sheet stopper so that, after a loop is formed in the tail end of the sheet, the sheet is discharged onto said sheet stacking portion;

sheet auxiliary convey means provided between said sheet feed-in means and the sheet stopper for auxiliary conveying the sheet on said sheet feed-in means, wherein said sheet auxiliary convey means comprises an endless belt rotated in a sheet conveying direction;

biasing means for biasing the tail end of the sheet fed by said sheet feed-in means toward a conveying direction;

sheet stopper retracting means for retracting said sheet stopper from a position where the sheet on said sheet stacking portion abuts against said sheet stopper;

an aligning member for aligning the sheet in a sheet width-wise direction;

convey means for pinching a sheet bundle from above and below and for conveying the sheet bundle, in which the sheets are aligned in the sheet width-wise direction and the ends of the sheets are aligned by said sheet stopper; and control means for shifting the sheet bundle by said convey means to a stapling position where the sheet bundle is stapled by a stapling mechanism portion, after said sheet stopper is retracted by said sheet stopper retracting means.

5. A discharged sheet stacking apparatus comprising:

a sheet stopper;

sheet feed-in means disposed at a position spaced apart from said sheet stopper by a distance smaller than a length of the sheet for pinching and feeding a sheet onto a sheet stacking portion on which a plurality of sheets are stacked and for causing a tip end of the sheet to abut against said sheet stopper, wherein said sheet feed-in means continues the feeding operation while pinching a tail end of the sheet even after the tip end of the sheet abuts against said sheet stopper so that, after a loop is formed in the tail end of the sheet, the sheet is discharged onto said sheet stacking portion;

biasing means for biasing the tail end of the sheet fed by said sheet feed-in means toward a conveying direction, wherein said biasing means comprises an endless belt rotated in synchronism with said sheet feed-in means;

sheet stopper retracting means for retracting said sheet stopper from a position where the sheet on said sheet stacking portion abuts against said sheet stopper;

an aligning member for aligning the sheet in a sheet width-wise direction;

convey means for pinching a sheet bundle from above and below and for conveying the sheet bundle, in which the sheets are aligned in the sheet width-wise direction and the ends of the sheets are aligned by said sheet stopper; and control means for shifting the sheet bundle by said convey means to a stapling position where the sheet bundle is stapled by a stapling mechanism portion, after said sheet stopper is retracted by said sheet stopper retracting means.

6. A discharged sheet stacking apparatus comprising:

a sheet stopper;

sheet feed-in means disposed at a position spaced apart from said sheet stopper by a distance smaller than a length of the sheet for pinching and feeding a sheet onto a sheet stacking portion on which a plurality of sheets are stacked and for causing a tip end of the sheet to abut against said sheet stopper, wherein said sheet feed-in means continues the feeding operation while pinching a tail end of the sheet even after the tip end of the sheet abuts against said sheet stopper so that, after a loop is formed in the tail end of the sheet, the sheet is discharged onto said sheet stacking portion;

biasing means for biasing the tail end of the sheet fed by said sheet feed-in means toward a conveying direction;

wherein said biasing means comprises an endless belt rotated in synchronism with said sheet feed-in means;

wherein said endless belt is designed so that it drops the sheet while receiving the tail end of the sheet in a condition that the tip end of the sheet abuts against said sheet stopper;

sheet stopper retracting means for retracting said sheet stopper from a position where the sheet on said sheet stacking portion abuts against said sheet stopper;

an aligning member for aligning the sheet in a sheet width-wise direction;

convey means for pinching a sheet bundle from above and below and for conveying the sheet bundle, in which the sheets are aligned in the sheet width-wise direction and the ends of the sheets are aligned by said sheet stopper; and control means for shifting the sheet bundle by said convey means to a stapling position where the sheet bundle is stapled by a stapling mechanism portion, after said sheet stopper is retracted by said sheet stopper retracting means.

7. A discharged sheet stacking apparatus according to any one of claims 1 through 4, 5, and 6, wherein said aligning member is provided with an elastic member for urging the sheet elastically.

8. An image forming apparatus comprising:

a main body having an image forming portion for forming an image; and a discharged sheet stacking apparatus according to any one of claims 1 to 4, 5, or 6 being disposed in said main body.

* * * * *

UNITED STATES PATENT AND TRADEMARK OFFICE

CERTIFICATE OF CORRECTION

PATENT NO. : 6,352,253 B1 
DATED : March 5, 2002
INVENTOR(S) : Yasuyoshi Hayakawa et al.

It is certified that error appears in the above-identified patent and that said Letters Patent is hereby corrected as shown below:

Title page,
Item [56], References Cited, U.S. PATENT DOCUMENTS: "Dboose et al." should read -- Dhooge et al. -- and "Rizzollo et al." should read -- Rizzalo et al. --.
FOREIGN PATENT DOCUMENTS: "403259857 A" should read -- 3-259857 --.
Item [57], ABSTRACT,
Line 5, "feed in" should read -- feed-in --.

Column 2,
Line 59, "the" (first occurrence) should be deleted.

Column 3,
Line 27, "auxiliary" should read -- auxiliarily --; and
Line 35, "synchronous" should read -- synchronicity --.

Column 4,
Line 32, "the" should be deleted.

Column 19,
Line 59, "same" should read -- said --.

Column 22,
Line 54, "claims 1 through 4, 5, and 6," should read -- claims 1 through 6, --; and
Line 62, "claims 1 to 4, 5, and 6," should read -- claims 1 through 6, --.

Signed and Sealed this

Tenth Day of December, 2002

JAMES E. ROGAN
*Director of the United States Patent and Trademark Office*